US009901792B2

(12) United States Patent
Franklin et al.

(10) Patent No.: US 9,901,792 B2
(45) Date of Patent: Feb. 27, 2018

(54) GOLF CLUBS AND GOLF CLUB HEADS

(71) Applicant: Nike, Inc., Beaverton, OR (US)

(72) Inventors: David N. Franklin, Granbury, TX (US); Brian Kammerer, Ft. Worth, TX (US)

(73) Assignee: NIKE, Inc., Beaverton, OR (US)

( * ) Notice: Subject to any disclaimer, the term of this patent is extended or adjusted under 35 U.S.C. 154(b) by 294 days.

(21) Appl. No.: 14/290,398

(22) Filed: May 29, 2014

(65) Prior Publication Data

US 2015/0031474 A1 Jan. 29, 2015

Related U.S. Application Data

(63) Continuation-in-part of application No. 13/308,079, filed on Nov. 30, 2011, now Pat. No. 9,072,948.

(51) Int. Cl.

| | |
|---|---|
| ***A63B 53/04*** | (2015.01) |
| ***A63B 53/06*** | (2015.01) |
| *A63B 60/52* | (2015.01) |
| *A63B 60/54* | (2015.01) |

(52) U.S. Cl.

CPC ..... *A63B 53/0487* (2013.01); *A63B 53/04* (2013.01); *A63B 53/047* (2013.01); *A63B 53/0466* (2013.01); *A63B 60/52* (2015.10); *A63B 60/54* (2015.10); *A63B 2053/045* (2013.01); *A63B 2053/0425* (2013.01); *A63B 2053/0433* (2013.01);

(Continued)

(58) Field of Classification Search

USPC ..... 473/324–350

See application file for complete search history.

(56) References Cited

U.S. PATENT DOCUMENTS

| | | | |
|---|---|---|---|
| 537,927 | A | 4/1895 | Rivoire |
| 546,540 | A | 9/1895 | Kennedy |
| 1,219,417 | A | 3/1917 | Vories |

(Continued)

FOREIGN PATENT DOCUMENTS

| | | | |
|---|---|---|---|
| FR | 2672226 | A1 | 8/1992 |
| GB | 2374539 | A | 10/2002 |

(Continued)

OTHER PUBLICATIONS

Feb. 27, 2013—(WO) ISR & WO—App. No. PCT/US12/067050.

(Continued)

*Primary Examiner* — Alvin Hunter

(74) *Attorney, Agent, or Firm* — Banner & Witcoff, Ltd.

(57) ABSTRACT

A head for a ball striking device includes a face having a striking surface and a rear side located behind the face, a rear member connected to the rear side of the face member and having a front surface confronting the rear side of the face member, and a resilient material separating the rear member from the face member, such that the resilient member engages the rear member and the face member and is configured to transfer momentum between the face member and the rear member. The face member has projections extending rearwardly from the rear side of the face member proximate the heel and toe sides of the head. The rear member has receivers in the front surface on the heel and toe sides of the head, where the projections are received in the corresponding receivers.

28 Claims, 7 Drawing Sheets

(52) U.S. Cl.
CPC ..... *A63B 2053/0491* (2013.01); *A63B 2053/0495* (2013.01); *A63B 2209/00* (2013.01)

(56) References Cited

U.S. PATENT DOCUMENTS 1,222,770 A 4/1917 Kaye
1,429,569 A 9/1922 Craig
1,463,533 A * 7/1923 Kurz, Jr. ..... A63B 53/04 473/342
1,506,733 A 9/1924 Bugbee
1,509,733 A 9/1924 Langford
1,568,485 A 1/1926 Turney
1,594,850 A 8/1926 Perkins
1,867,103 A 7/1932 Schavoir
2,171,383 A 8/1939 Wettlaufer
2,217,338 A 10/1940 Fuller
2,222,534 A 11/1940 Henry
2,305,270 A 12/1942 Nilson
2,329,313 A 9/1943 Winter
2,429,351 A 10/1947 Fetterolf
2,455,150 A 11/1948 Verderber
2,503,506 A * 4/1950 Miller ..... A63B 69/3685 473/251
2,520,702 A 8/1950 Verderber
2,571,970 A 10/1951 Verderber
2,593,368 A 4/1952 Verderber
2,777,694 A 1/1957 Winter
3,214,169 A 10/1965 Rupnow
3,305,235 A 2/1967 Williams, Jr.
3,516,674 A * 6/1970 Scarborough ..... A63B 53/0487 473/311
3,519,271 A 7/1970 Smith
3,601,399 A 8/1971 Agens et al.
3,791,647 A 2/1974 Verderber
3,840,231 A 10/1974 Moore
3,980,301 A 9/1976 Smith
4,121,832 A * 10/1978 Ebbing ..... A63B 53/007 473/288
D267,965 S 2/1983 Kobayashi
4,632,400 A 12/1986 Boone
4,792,140 A 12/1988 Yamaguchi et al.
4,811,950 A * 3/1989 Kobayashi ..... A63B 53/04 473/335
4,842,280 A 6/1989 Hilton
4,878,666 A 11/1989 Hosoda
4,884,808 A * 12/1989 Retzer ..... A63B 53/04 473/288
4,927,144 A 5/1990 Stormon
4,928,972 A 5/1990 Nakanishi et al.
4,984,800 A * 1/1991 Hamada ..... A63B 53/04 264/241
5,154,425 A 10/1992 Niskanen et al.
5,183,255 A 2/1993 Antonious
5,275,413 A 1/1994 Sprague
5,290,036 A 3/1994 Fenton et al.
5,292,123 A 3/1994 Schmidt, Jr. et al.
5,297,803 A 3/1994 Solheim
5,299,807 A 4/1994 Hutin
5,344,151 A 9/1994 Anderson et al.
5,346,213 A 9/1994 Yamada
5,390,920 A * 2/1995 Nickum ..... A63B 53/06 473/246
5,393,056 A 2/1995 Richardson
5,398,929 A 3/1995 Kitaichi
5,407,202 A 4/1995 Igarashi
5,413,337 A 5/1995 Goodman et al.
5,429,356 A * 7/1995 Dingle ..... A63B 53/02 473/251
5,433,441 A 7/1995 Olsen et al.
5,435,551 A 7/1995 Chen
5,439,223 A 8/1995 Kobayashi
5,447,307 A 9/1995 Antonious
5,472,201 A 12/1995 Aizawa et al.
5,485,997 A 1/1996 Schmidt et al.
5,492,327 A 2/1996 Biafore, Jr.
5,516,097 A 5/1996 Huddleston
5,518,240 A 5/1996 Igarashi
5,518,243 A 5/1996 Redman
5,540,436 A 7/1996 Boone
D375,130 S 10/1996 Hlinka et al.
5,564,705 A 10/1996 Kobayashi et al.
5,586,947 A 12/1996 Hutin
5,601,498 A 2/1997 Antonious
5,611,740 A 3/1997 Nagamoto
D378,770 S 4/1997 Hlinka et al.
5,632,695 A 5/1997 Hlinka et al.
5,643,111 A 7/1997 Igarashi
5,649,872 A 7/1997 Antonious
5,658,208 A 8/1997 Shimasaki
5,674,132 A 10/1997 Fisher
5,676,606 A * 10/1997 Schaeffer ..... A63B 53/0487 473/340
5,692,972 A 12/1997 Langslet
5,697,855 A 12/1997 Aizawa
5,716,290 A 2/1998 Baker et al.
5,749,794 A 5/1998 Kobayashi et al.
5,755,625 A 5/1998 Jackson
5,772,525 A 6/1998 Klein
5,772,526 A 6/1998 Hano
5,803,825 A * 9/1998 Hamilton ..... A63B 53/0487 473/252
5,820,481 A * 10/1998 Raudman ..... A63B 53/0487 473/313
5,833,551 A 11/1998 Vincent et al.
5,851,157 A 12/1998 Koide et al.
5,863,257 A * 1/1999 Busnardo ..... A63B 53/02 473/246
5,890,976 A 4/1999 Anderson
5,930,887 A 8/1999 Tomita et al.
5,931,741 A 8/1999 Fenton, Jr.
5,993,324 A 11/1999 Gammil
6,001,028 A 12/1999 Tang et al.
6,001,030 A * 12/1999 Delaney ..... A63B 53/0487 473/329
6,027,415 A 2/2000 Takeda
6,030,295 A 2/2000 Takeda
6,080,068 A 6/2000 Takeda
6,095,931 A * 8/2000 Hettinger ..... A63B 53/0487 473/341
6,159,109 A 12/2000 Langslet
6,162,133 A 12/2000 Peterson
6,171,204 B1 1/2001 Starry
6,176,791 B1 1/2001 Wright
6,186,903 B1 2/2001 Beebe et al.
6,206,788 B1 3/2001 Krenzler
6,217,461 B1 4/2001 Galy
6,270,423 B1 * 8/2001 Webb ..... A63B 53/0487 473/226
6,299,546 B1 10/2001 Wang
6,302,807 B1 10/2001 Rohrer
6,328,661 B1 12/2001 Helmstetter et al.
6,332,848 B1 12/2001 Long et al.
6,348,009 B1 2/2002 Dischler
6,386,987 B1 5/2002 Lejeune, Jr.
6,428,423 B1 8/2002 Merko
6,431,997 B1 * 8/2002 Rohrer ..... A63B 53/04 473/324
6,443,857 B1 9/2002 Chuang
6,478,690 B2 * 11/2002 Helmstetter ..... A63B 53/0487 473/324
6,514,153 B2 2/2003 Miyamoto et al.
6,514,155 B1 2/2003 Sheets
6,524,197 B2 2/2003 Boone
6,533,679 B1 3/2003 McCabe et al.
6,558,271 B1 5/2003 Beach et al.
6,625,848 B1 9/2003 Schneider
6,648,773 B1 11/2003 Evans
6,676,533 B1 1/2004 Hsien
6,743,112 B2 * 6/2004 Nelson ..... A63B 53/0487 473/251
6,769,998 B2 8/2004 Clausen et al.
6,811,496 B2 11/2004 Wahl et al.

(56) References Cited

U.S. PATENT DOCUMENTS 6,872,153 B2 3/2005 Gilbert et al.
6,875,124 B2 4/2005 Gilbert et al.
6,932,717 B2 8/2005 Hou et al.
6,964,617 B2 11/2005 Williams
7,025,692 B2 4/2006 Erickson et al.
7,048,646 B2 5/2006 Yamanaka et al.
7,070,513 B2 7/2006 Takeda et al.
7,074,132 B1 7/2006 Finn
7,083,525 B2 8/2006 Pond et al.
7,108,609 B2 9/2006 Stites et al.
7,128,664 B2 10/2006 Onoda et al.
7,232,377 B2 6/2007 Gilbert et al.
7,244,188 B2 7/2007 Best
7,281,985 B2 10/2007 Galloway
7,297,072 B2 11/2007 Meyer et al.
7,371,190 B2 5/2008 Gilbert et al.
7,410,427 B2 8/2008 Imamoto et al.
7,410,428 B1 8/2008 Dawson et al.
7,419,439 B1 9/2008 Aleamoni
7,431,662 B2 * 10/2008 Tucker, Sr. ..... A63B 53/06 473/288
7,452,283 B2 11/2008 Hettinger et al.
7,473,186 B2 * 1/2009 Best ..... A63B 53/0487 473/329
7,530,902 B2 5/2009 Nakamura
7,540,810 B2 * 6/2009 Hettinger ..... A63B 53/0487 473/331
7,559,850 B2 7/2009 Gilbert et al.
7,566,276 B2 7/2009 Billings
7,575,523 B2 8/2009 Yokota
7,588,503 B2 * 9/2009 Roach ..... A63B 53/047 473/332
7,601,077 B2 * 10/2009 Serrano ..... A63B 53/0487 473/332
7,641,569 B2 1/2010 Best et al.
7,651,409 B1 * 1/2010 Mier ..... A63B 53/007 473/330
7,677,987 B2 3/2010 Hilton
D613,357 S 4/2010 Utz
7,717,807 B2 5/2010 Evans et al.
7,740,545 B2 6/2010 Cameron
7,753,809 B2 7/2010 Cackett et al.
7,794,334 B2 9/2010 Hilton
7,798,914 B2 9/2010 Noble et al.
7,854,667 B2 12/2010 Gillig
7,887,432 B2 2/2011 Jones et al.
7,892,106 B2 2/2011 Matsunaga
7,934,999 B2 5/2011 Cackett et al.
7,997,999 B2 8/2011 Roach et al.
8,007,371 B2 8/2011 Breier et al.
8,057,322 B2 11/2011 Wallans
8,092,318 B2 * 1/2012 Oldknow ..... A63B 53/04 473/329
8,133,128 B2 3/2012 Boyd et al.
8,157,673 B2 4/2012 Gilbert et al.
8,177,664 B2 5/2012 Horii et al.
8,206,241 B2 6/2012 Boyd et al.
8,210,961 B2 7/2012 Finn et al.
8,272,976 B2 9/2012 DAgostino
8,382,604 B2 2/2013 Billings
8,475,292 B2 7/2013 Rahrig et al.
8,517,673 B2 8/2013 Ambrosy et al.
8,517,851 B2 8/2013 Cackett et al.
8,523,698 B2 * 9/2013 Hotaling ..... A63B 53/04 473/251
8,535,171 B2 9/2013 McGinnis, Jr.
8,608,589 B2 12/2013 Ferguson et al.
8,657,702 B2 2/2014 Boyd et al.
8,702,533 B2 4/2014 Evans
8,771,098 B2 * 7/2014 Hilton ..... A63B 53/08 473/251
8,900,064 B2 12/2014 Franklin
8,956,244 B1 2/2015 Westrum et al.
8,979,668 B2 * 3/2015 Nakamura ..... A63B 53/0487 473/329
9,028,342 B2 5/2015 Stites et al.
9,033,817 B2 * 5/2015 Snyder ..... A63B 53/047 156/242
9,072,948 B2 * 7/2015 Franklin ..... A63B 53/04
9,089,747 B2 7/2015 Boyd et al.
9,101,805 B2 8/2015 Stites et al.
9,101,808 B2 8/2015 Stites et al.
9,186,546 B2 11/2015 Boyd et al.
2002/0025859 A1 2/2002 Finn
2002/0169036 A1 11/2002 Boone
2003/0032499 A1 2/2003 Wahl et al.
2003/0236134 A1 12/2003 Nishitani
2004/0018886 A1 1/2004 Burrows
2004/0132541 A1 7/2004 MacLlraith
2005/0049078 A1 3/2005 Yamanaka et al.
2005/0192116 A1 9/2005 Imamoto
2005/0272527 A1 12/2005 Sugimoto
2006/0148585 A1 7/2006 Vinton
2006/0154746 A1 7/2006 Hagood et al.
2006/0154747 A1 7/2006 Beach
2006/0172816 A1 8/2006 Johnson
2007/0129165 A1 6/2007 Matsunaga et al.
2007/0142123 A1 6/2007 Franklin
2007/0259735 A1 11/2007 Beckman
2007/0298904 A1 12/2007 Dworzan
2008/0004132 A1 1/2008 Lin et al.
2008/0009360 A1 1/2008 Purtill
2008/0085781 A1 4/2008 Iwahori
2009/0298613 A1 12/2009 Hirsch et al.
2010/0029409 A1 2/2010 Noble et al.
2010/0167836 A1 7/2010 Horii et al.
2010/0184527 A1 7/2010 Demkowski et al.
2010/0203983 A1 8/2010 Stites
2010/0261546 A1 * 10/2010 Nicodem ..... A63B 53/0487 473/340
2011/0021287 A1 1/2011 Tucker, Sr. et al.
2011/0034270 A1 * 2/2011 Wahl ..... A63B 53/047 473/342
2011/0081987 A1 4/2011 Gillig
2011/0086722 A1 4/2011 Oldknow et al.
2011/0224017 A1 9/2011 Thomas et al.
2011/0275446 A1 11/2011 Rahrig et al.
2012/0108357 A1 5/2012 Nakamura
2012/0122607 A1 5/2012 Reinberg
2013/0095953 A1 4/2013 Hotaling et al.
2013/0109501 A1 5/2013 Stites et al.
2013/0137533 A1 5/2013 Franklin et al.
2013/0157774 A1 6/2013 Chen
2013/0178307 A1 7/2013 Wicketts
2013/0203522 A1 8/2013 Franklin et al.
2013/0281227 A1 10/2013 Roach et al.
2014/0045607 A1 2/2014 Hilton
2014/0187346 A1 7/2014 Beno et al.
2014/0256463 A1 9/2014 Knight
2015/0080147 A1 3/2015 Cameron
2015/0297959 A1 10/2015 Lee
2015/0335966 A1 11/2015 Cameron
2016/0129320 A1 5/2016 Dolezel et al.
2016/0129321 A1 5/2016 Dolezel

FOREIGN PATENT DOCUMENTS

JP H07031698 A 2/1995
JP H09000666 1/1997
JP H09117537 A 5/1997
JP H09215785 A 8/1997
JP H09276455 A 10/1997
JP H10076031 A 3/1998
JP H10127836 A 5/1998
JP H1114112 A 1/1999
JP H1157082 A 3/1999
JP 11114112 A * 4/1999
JP H11114112 A 4/1999
JP H11137731 A 5/1999
JP H11169493 A 6/1999
JP H11244431 A 9/1999

(56) References Cited

FOREIGN PATENT DOCUMENTS

| | | | | |
|---|---|---|---|---|
| JP | 2000126337 | A | | 5/2000 |
| JP | 2001054599 | A | * | 2/2001 |
| JP | 2004141350 | A | * | 5/2004 |
| JP | 2004201879 | A | | 7/2004 |
| JP | 2004351096 | A | | 12/2004 |
| JP | 2005131280 | A | | 5/2005 |
| JP | 2005211613 | A | | 8/2005 |
| JP | 2005245576 | A | | 9/2005 |
| JP | 2005305178 | A | | 11/2005 |
| JP | 2005342215 | A | | 12/2005 |
| JP | 2006000435 | A | | 1/2006 |
| JP | 2006333876 | A | | 12/2006 |
| JP | 2007330335 | A | | 12/2007 |
| JP | 2009297210 | A | | 12/2009 |
| JP | 2010148565 | A | | 7/2010 |
| JP | 2010148652 | A | | 7/2010 |
| JP | 2010154887 | A | | 7/2010 |
| JP | 2011004849 | A | | 1/2011 |
| JP | 2011224366 | A | | 11/2011 |
| WO | 9709095 | A1 | | 3/1997 |
| WO | 9920358 | A1 | | 4/1999 |

OTHER PUBLICATIONS

Oct. 28, 2015—(WO) ISR & WO—App. No. PCT/US15/033371.
Sep. 28, 2015—(WO) International Search Report and Written Opinion—App PCT/US2015/032819.
Jul. 12, 2016—(WO) ISR & WO—App. No. PCT/US15/032821.
Oct. 10, 2016—(WO) ISR & WO—App. No. PCT/US16/033014.
Sep. 29. 2016—(WO) International Search Report and Written Opinion—App PCT/US2016/033025.
Oct. 28, 2015—(WO) ISR & WO—App. No. PCT/US15/033128.
Sep. 11, 2015—(WO) ISR & WO—App. No. PCT/US15/032665.
Machine Translation of JP H11-114112.

* cited by examiner

GOLF CLUBS AND GOLF CLUB HEADS

CROSS REFERENCE TO RELATED APPLICATION

This application claims priority to, and is a continuation-in-part of, co-pending U.S. patent application Ser. No. 13/308,079, filed Nov. 30, 2011.

TECHNICAL FIELD

The invention relates generally to ball striking devices, such as golf clubs and golf club heads, utilizing features for transfer of energy and/or momentum. Certain aspects of this invention relate to golf club heads having a rear member configured to transfer energy and/or momentum to the face upon an impact on the face.

BACKGROUND

Golf clubs and many other ball striking devices can encounter undesirable effects when the ball being struck impacts the ball striking head away from the optimum location, which may be referred to as an "off-center impact." In a golf club head, this optimum location is, in many cases, aligned laterally and/or vertically with the center of gravity (CG) of the head. Even slightly off-center impacts can sometimes significantly affect the performance of the head, and can result in reduced velocity and/or energy transfer to the ball, inconsistent ball flight direction and/or spin caused by twisting of the head, increased vibration that can produce undesirable sound and/or feel, and other undesirable effects. Technologies that can reduce or eliminate some or all of these undesirable effects could have great usefulness in golf club heads and other ball striking devices.

The present devices and methods are provided to address at least some of the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the disclosure relate to ball striking devices, such as golf clubs, with a head that includes a face member including a face having a striking surface configured for striking a ball and a rear side located behind the face, a rear member connected to the rear side of the face member and having a front surface confronting the rear side of the face member, and a resilient material separating the rear member from the face member, such that the resilient member engages the rear member and the face member and is configured to transfer momentum between the face member and the rear member. The face member has a first projection extending rearwardly from the rear side of the face member proximate a heel side of the head and a second projection extending rearwardly from the rear side of the face member proximate a toe side of the head. The rear member has a first receiver in the front surface on the heel side of the head and a second receiver in the front surface on the toe side of the head, where the first projection is received in the first receiver and the second projection is received in the second receiver.

According to one aspect, the resilient material covers the first and second projections and separates the first and second projections from the openings.

According to another aspect, the head further includes an engagement member connecting the face member to the rear member, where the engagement member forms a joint between the face member and the rear member. The engagement member may have many different configurations, such as a pin connected to the face member and received in an aperture in the rear member. Additionally, the engagement member may be approximately aligned laterally with a center of gravity of the club head.

According to a further aspect, the head may also include a wall extending rearward from the face portion, where the rear member is positioned below the wall, such that the wall covers at least a portion of the rear member, and where the rear member forms at least a portion of a sole of the club head. The wall may cover a front portion of the top surface of the rear member in one configuration. Additionally, the rear member may have perimeter weighting portions located at the heel side and the toe side of the head and a thinned portion between the perimeter weighting portions, and the wall follows contours of the rear member to at least partially cover the perimeter weighting portions and the thinned portion.

According to yet another aspect, the rear member has perimeter weighting portions located at the heel side and the toe side of the head and a thinned portion between the perimeter weighting portions, and the first receiver and the second receiver are located in the perimeter weighting portions.

According to a still further aspect, the face member has a recess located on a sole of the head, where at least a portion of the rear member is received in the recess, such that the rear member forms at least a portion of the sole.

Additional aspects of the disclosure relate to ball striking devices, such as golf clubs, with a head that includes a face member including a face having a striking surface configured for striking a ball and a rear side located behind the face, a rear member connected to the rear side of the face member, and a resilient material separating the rear member from the face member, such that the resilient member engages the rear member and the face member and is configured to transfer momentum between the face member and the rear member. The face member includes a face portion at least partially defining the face and a wall extending rearward from the face portion. The rear member is positioned below the wall, such that the wall covers at least a portion of the rear member, and the rear member forms at least a portion of a sole of the club head. In one configuration, the wall may cover a front portion of the top surface of the rear member. Additionally, in one configuration, the wall and the face portion of the face member may be formed of a single integral piece.

According to one aspect, the resilient material is positioned between a front surface of the rear member and a rear surface of the face portion of the face member and between a top surface of the rear member and an underside of the wall.

According to another aspect, the face member further includes a first projection extending rearwardly from the rear side of the face member proximate a heel side of the head and a second projection extending rearwardly from the rear side of the face member proximate a toe side of the head. The rear member further includes a first receiver in a front surface of the rear member on a heel side of the head and a second receiver in the front surface on the toe side of the head, and the first projection is received in the first receiver and the second projection is received in the second receiver. The rear member may have perimeter weighting portions located at the heel side and the toe side of the head and a thinned portion between the perimeter weighting portions in one configuration, such that the first receiver and the second receiver are located in the perimeter weighting portions. Additionally, the resilient material may cover the first and second projections and separate the first and second projections from the openings.

According to a further aspect, the head also includes an engagement member connecting the face member to the rear member, and the engagement member forms a joint between the face member and the rear member. The engagement member may have many different configurations, such as a pin connected to the face member and received in an aperture in the rear member. Additionally, the engagement member may be approximately aligned laterally with a center of gravity of the club head.

According to yet another aspect, the rear member has perimeter weighting portions located at the heel side and the toe side of the head and a thinned portion between the perimeter weighting portions, and the wall follows contours of the rear member to at least partially cover the perimeter weighting portions and the thinned portion.

According to a still further aspect, the face member has a recess located on the sole and below the wall, and at least a portion of the rear member is received in the recess.

Further aspects of the disclosure relate to ball striking devices, such as golf clubs, with a head that includes a face member including a face having a striking surface configured for striking a ball and a rear side located behind the face, a rear member connected to the rear side of the face member and having a front surface confronting the rear side of the face member, an engagement member connecting the face member to the rear member, and a resilient material separating the rear member from the face member, such that the resilient member engages the rear member and the face member and is configured to transfer momentum between the face member and the rear member. The face member includes a face portion at least partially defining the face and a wall extending rearward from the face portion. The face member further includes a first projection extending rearwardly from the rear side of the face member proximate a heel side of the head and a second projection extending rearwardly from the rear side of the face member proximate a toe side of the head. The rear member is positioned below the wall, such that the wall covers at least a portion of the rear member, and the rear member forms at least a portion of a sole of the club head. Additionally, the rear member has a first receiver in the front surface on a heel side of the head and a second receiver in the front surface on the toe side of the head, and the first projection is received in the first receiver and the second projection is received in the second receiver. The engagement member forms a joint between the face member and the rear member.

Other aspects of the disclosure relate to a golf club or other ball striking device including a head or other ball striking device as described above and a shaft connected to the head/device and configured for gripping by a user. The shaft may be connected to the face member of the head. Aspects of the disclosure relate to a set of golf clubs including at least one golf club as described above. Yet additional aspects of the disclosure relate to a method for manufacturing a ball striking device as described above, including connecting a rear member and/or a resilient material to a face member as described above.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
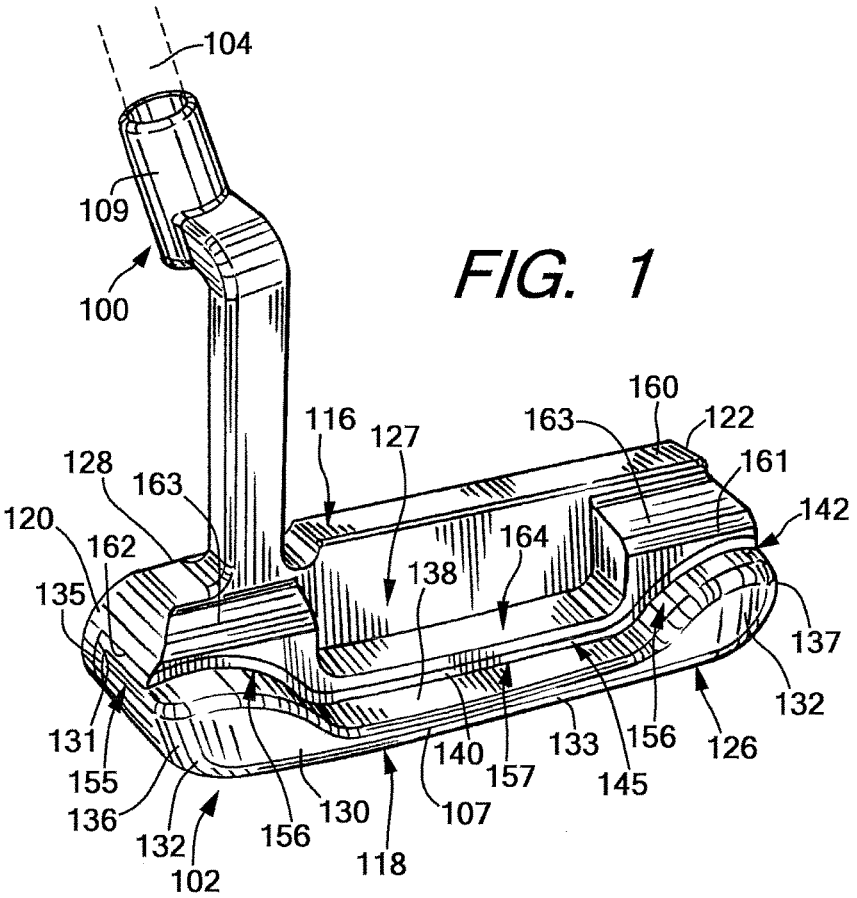
FIG. 1 is a top rear perspective view of one embodiment of a ball striking device according to aspects of the present invention, in the form of a golf putter.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," "primary," "secondary," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The term "shaft" includes the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like. In many bonds made by "integral joining techniques," separation of the joined pieces cannot be accomplished without structural damage thereto.

"Approximately" or "about" means within a range of +/−10% of the nominal value modified by such term.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface may constitute a substantially flat surface on one face of the ball striking head, although some curvature may be provided (e.g., "bulge" or "roll" characteristics). Some more specific aspects described herein relate to putters and putter heads, although aspects described herein may also be utilized in wood-type golf clubs and golf club heads, including drivers, fairway woods, hybrid-type clubs, as well as iron-type golf clubs, other types of golf clubs or other ball striking devices, if desired.

According to various aspects of this invention, the ball striking device may be formed of one or more of a variety of materials, such as metals (including metal alloys), ceramics, polymers, composites, fiber-reinforced composites, and wood, and the devices may be formed in one of a variety of configurations, without departing from the scope of the invention. In one embodiment, some or all components of the head, including the face and at least a portion of the body of the head, are made of metal materials. It is understood that the head also may contain components made of several different materials. Additionally, the components may be formed by various forming methods. For example, metal components (such as titanium, aluminum, titanium alloys, aluminum alloys, steels (such as stainless steels), and the like) may be formed by forging, molding, casting, stamping, machining, and/or other known techniques. In another example, polymer and/or composite components, such as carbon fiber-polymer composites, can be manufactured by a variety of composite processing techniques, such as prepreg processing, powder-based techniques, mold infiltration, injection molding, and/or other known techniques.

The various figures in this application illustrate examples of ball striking devices and portions thereof according to this invention. When the same reference number appears in more than one drawing, that reference number is used consistently in this specification and the drawings to refer to the same or similar parts throughout.

At least some examples of ball striking devices according to this invention relate to golf club head structures, including heads for putter-type golf clubs. Such devices may include a one-piece construction or a multiple-piece construction. An example structure of ball striking devices according to this invention will be described in detail below in conjunction with FIGS. 1-12, and will be referred to generally using reference numeral "100."

FIGS. 1-7 illustrate an example of a ball striking device 100 in the form of a golf putter, in accordance with at least some examples of this invention. The ball striking device 100 includes a ball striking head 102 and a shaft 104 connected to the ball striking head 102 and extending therefrom. The ball striking head 102 of the ball striking device 100 of FIGS. 1-7 has a face member 128 that includes a face 112 and a hosel 109 extending therefrom. The face member 128 may include one or more structures connected to and/or located behind the face 112 that may be referred to as part of a "body" of the golf club head 102. The ball striking head 102 also has a rear member 130 connected to the face member 128, and a resilient material 140 positioned between the face member 128 and the rear member 130. The face member 128, the rear member 130, and the resilient material 140 may combine to define the golf club head body 107 in some embodiments. The shaft 104 may be connected to the body 107 at the hosel 109, as shown in FIG. 1, and may include a grip (not shown) in some embodiments. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Patent Application Publication No. 2009/0062029, filed on Aug. 28, 2007, U.S. Patent Application Publication No. 2013/0184098, filed on Oct. 31, 2012, and U.S. Pat. No. 8,533,060, issued Sep. 10, 2013, all of which are incorporated herein by reference in their entireties and made parts hereof.

For reference, the head 102 generally has a golf club head body 107 with a top 116, a bottom or sole 118, a heel 120 (also called a heel side or heel edge) proximate the hosel 109, a toe 122 (also called a toe side or toe edge) distal from the hosel 109, a front side 124, and a back or rear side 126. The shape and design of the head 102 may be partially dictated by the intended use of the device 100. In the club 100 shown in FIGS. 1-7, the head 102 has a wide, narrow or short face 112, as the club 100 is designed for use as a putter, intended to hit the ball short distances in a rolling manner. It is understood that the head 102 may be configured as a different type of ball striking device in other embodiments, including other types of putters or similar devices. In other applications, such as for a different type of golf club, the head may be designed to have different dimensions and configurations. If, for example, the head 102 is configured as a driver, the club head may have a volume of at least 400 cc, and in some structures, at least 450 cc, or even at least 460 cc. When configured as a fairway wood head, the club head may have a volume of at least 120-230 cc, and when configured as a hybrid club head, the club head may have a volume of at least 85-140 cc. Other appropriate sizes for other club heads may be readily determined by those skilled in the art.

The face 112 is located at the front 124 of the face member 128, and has a striking surface or ball striking surface 110 located thereon. The ball striking surface 110 is configured to face a ball in use (not shown), and is adapted to strike the ball when the device 100 is set in motion, such as by swinging. As shown, the ball striking surface 110 occupies most of the face 112. The face 112 may include some curvature in the top to bottom and/or heel to toe directions (e.g., bulge and roll characteristics), and may also include functional face grooves, as is known and is conventional in the art. In other embodiments, the surface 110 may occupy a different proportion of the face 112, or the face member 128 may have multiple ball striking surfaces 110 thereon. In the embodiment shown in FIGS. 1-7, the ball striking surface 110 has little to no incline or loft angle, to cause the ball to roll when struck. In other embodiments, the ball striking surface 110 may have an incline or loft angle, to launch the ball on a trajectory, such as for a wood-type or iron-type club head. Additionally, the face 112 may have one or more internal or external inserts in some embodiments.

It is understood that the face member 128 and/or the hosel 109 can be formed as a single piece or as separate pieces that are joined together. In the embodiment shown in FIGS. 1-7, as well as the embodiments shown in FIGS. 8-12, the face member 128, including the face 112 and potentially the hosel 109, are formed of a single, integral piece. In other embodiments, the face member 128 may be formed of multiple pieces, such as by using an insert to form all or part of the face 112, or a separate body member or members connected behind the face 112. Such multiple pieces may be joined using an integral joining technique, such as welding, cementing, or adhesively joining, or other known techniques, including many mechanical joining techniques, such as releasable mechanical engagement techniques. Further, the hosel 109 may also be formed as a separate piece, which may be joined using these or other techniques, or may be connected to the rear member 130. In an exemplary embodiment, the face 112 may include a face insert 150 that forms at least a portion of the ball striking surface 110, including inserts as described in U.S. Patent Application Publication 2010/0234127, which is incorporated by reference herein in its entirety and made part hereof.

Figure 6:
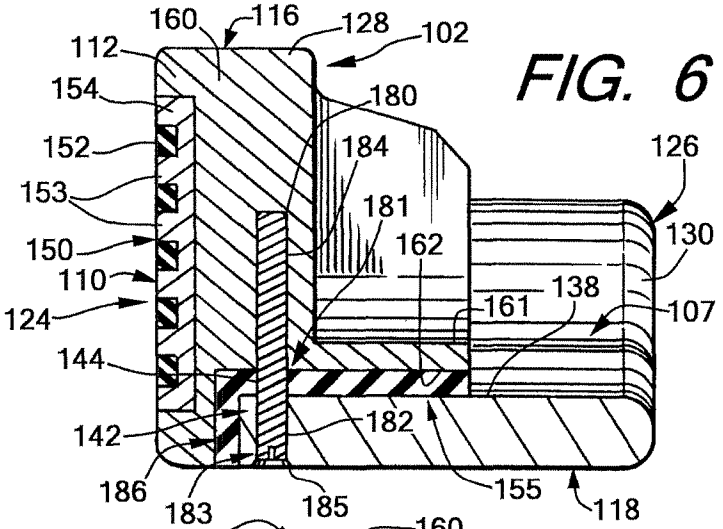
FIG. 6 is a cross-section view taken along line 6-6 of FIG. 3.
Figure 4:
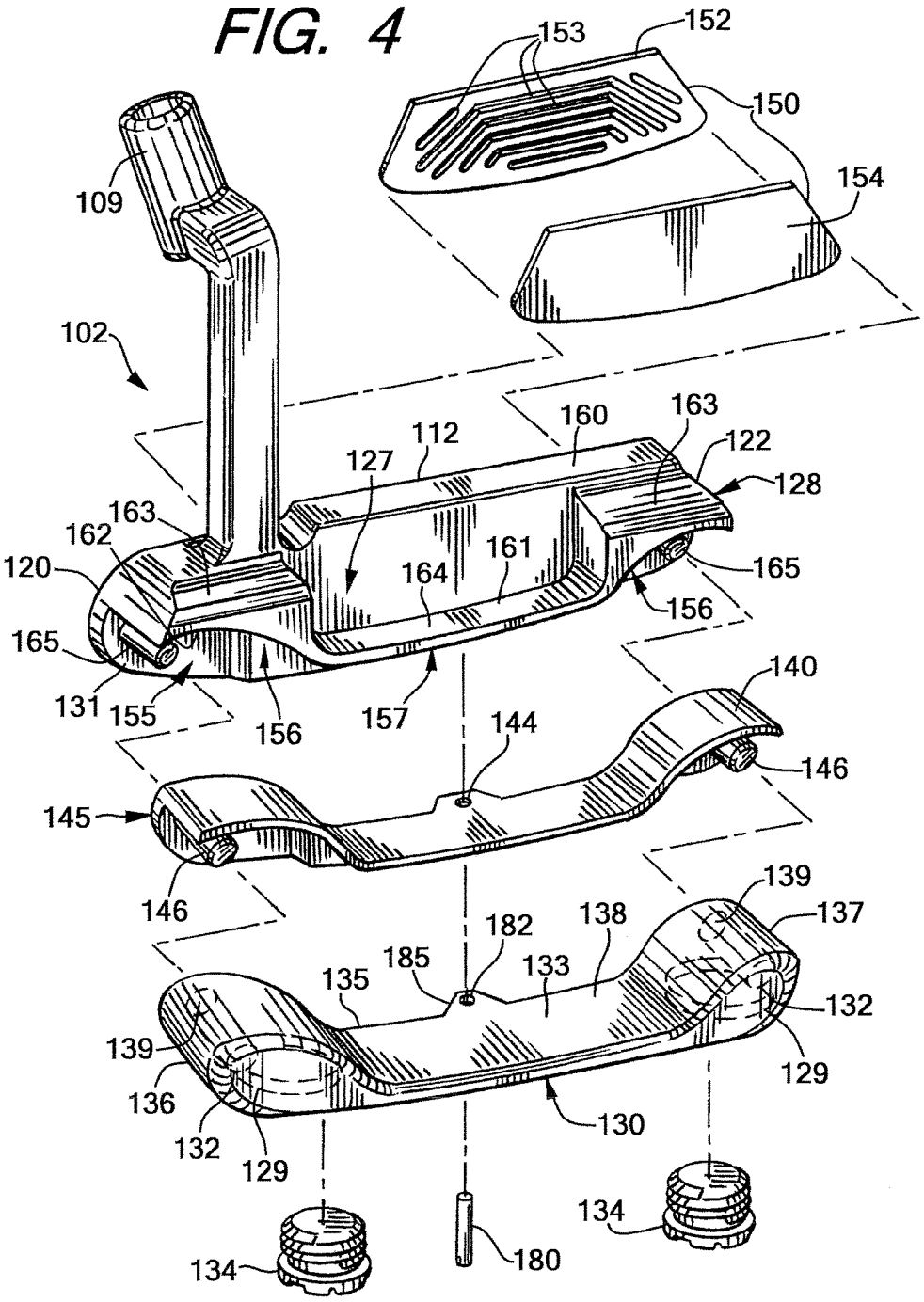
FIG. 4 is a top rear perspective exploded view of the ball striking device of FIG. 1.
Figure 5:
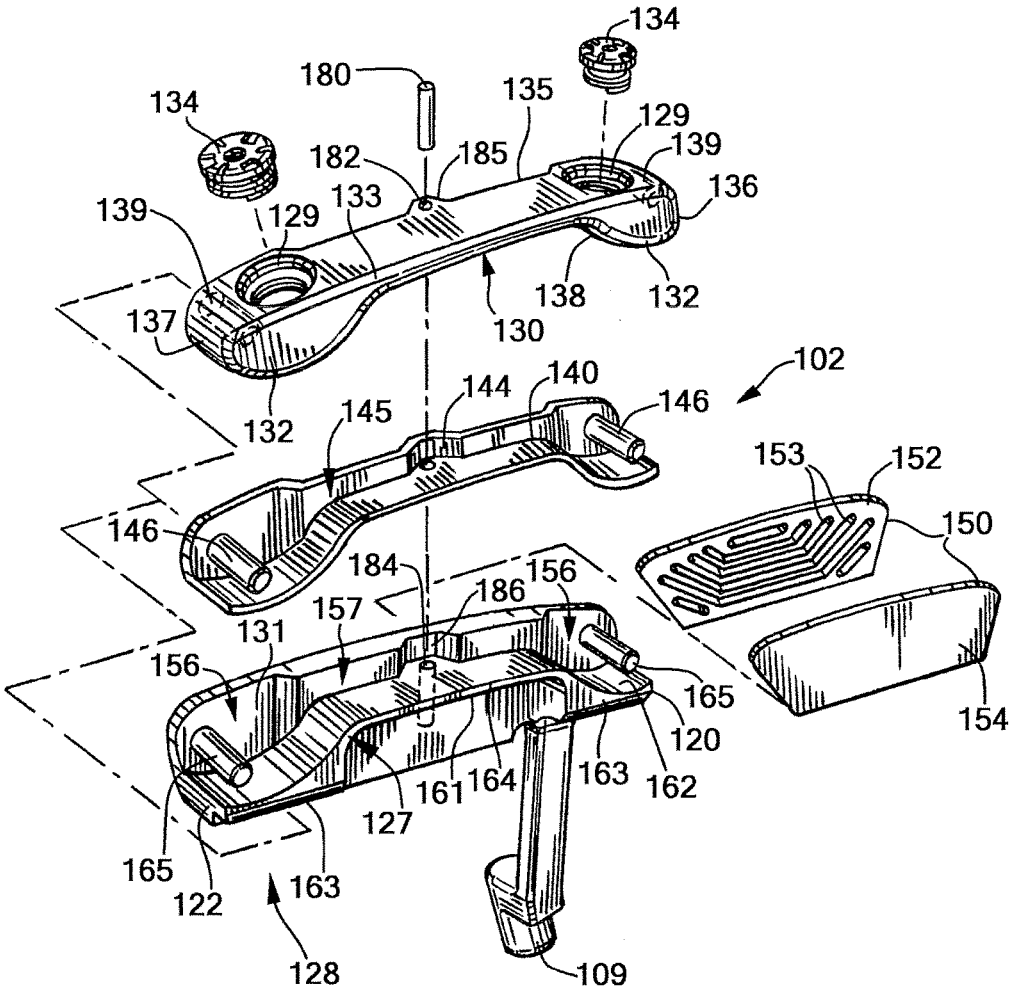
FIG. 5 is a bottom rear perspective exploded view of the ball striking device of FIG. 1.

FIGS. 4-6 illustrate one embodiment of a face insert 150 for the golf club head 102. In this embodiment, at least a portion of the ball striking surface 110 may be formed separately from the remainder of the face 112 and may include an insert 150 configured to be received in a recess 151 formed in the face 112. In the embodiment illustrated in FIGS. 4-6, the insert 150 includes a plate 152, into which grooves 153 of various sizes, configurations, shapes, etc. may be machined or otherwise formed. In some examples, the plate 152 may be between 1 mm and 4 mm thick and, in some examples, may be approximately 2 or 3 mm thick. The grooves 153 may, in some arrangements, extend completely through the plate 152 (i.e., forming a through hole in the plate), as shown in FIGS. 4-6, or may extend partially through the plate 152. The plate 152 may be formed of any suitable material, including metals such as aluminum, steel (e.g., stainless steel), titanium, nickel, beryllium, copper, combinations or alloys including these metals; polymers; and the like. The plate 152 may be pressed together (e.g., by "co-molding") with a moldable, polymer material backing 154, such as thermoplastic polyurethane or a thermoset material. The polymer material 154 may have a lower hardness than the plate 152 in one embodiment, e.g., as determined by a Shore D hardness test. In another embodiment, the polymer material 154 may have greater hardness. Connecting the polymer material 154 together with the front plate 152 forms the insert 150 having the polymer material 154 filling the grooves 153 formed in the plate 152, to provide a ball striking surface having two different materials that may have different hardnesses (e.g., metal and polymer) contacting the ball. The surface of the polymer backing material 154 may be pre-formed with projections to fit into the grooves 153, and/or the polymer material 154 may be forced into the grooves 153 during a pressing and/or molding operation. If necessary or desired, the plate 152 and polymer material 154 may be held together using an adhesive or cement (e.g., double sided tape), mechanical connectors, fusing techniques (e.g., welding, soldering, or brazing), etc. Further, if desired, score lines may be cut into the polymer material 154 and/or the plate 152 after the insert 150 has been manufactured. The insert 150 may be engaged with the recess 151 in the face 112 in any desired manner, such as via any joining techniques described herein, and may be releasably connected in one embodiment. Still further, the resilient material 140 may be any material described in U.S. Patent Application Publication No. 2013/0137533, filed Nov. 30, 2011, which application is incorporated by reference herein in its entirety and made part hereof.

The face member 128 in the embodiment of FIGS. 1-7 has a face portion 160 that defines at least a portion of the face 112 and a rearwardly-extending portion or wall 161 that extends rearwardly from the face portion 160. The face portion 160 generally defines at least a portion of the striking surface 110, which may also be partially defined by the face insert 150 in an embodiment as described above. In the embodiment shown in FIGS. 1-7, the rear side 127 of the face member 128 has a rear surface 131 opposite the striking surface 110. The rear surface 131 may be partially or entirely defined on the face portion 160 of the face member 128 in one embodiment, and may be considered to be a rear surface of the face 112 in such a configuration. The face member 128 may also have a recess 155 in the rear side 127 in one embodiment, such as illustrated in FIGS. 4-7, which may be located in the sole 118 and below the wall 161. The wall 161 may define a top surface of the recess 155 in one embodiment, and the rear member 130 may be at least partially received in this recess 155, as shown in FIGS. 4-7, such that the rear member 130 defines at least a portion of the sole 118 of the club head 102 in one embodiment. Additionally, in the embodiment of FIGS. 1-7, the wall 161 has approximately the same width (heel-to-toe) as the face portion 160. As shown in FIG. 5, the underside 162 of the wall 161 is contoured similarly to the top surface 138 of the rear member 130, such that the wall 161 at least partially covers the thinned portion 133 and the perimeter weighting portions 132, however the underside 162 may have a different structure in another embodiment. For example, the wall 161 may have raised portions 163 proximate the heel 120 and the toe 122 that create enlarged sections 156 of the cavity 155, as well as a depressed portion 164 proximate the lateral center of the head 102 that creates a narrowed section 157 of the cavity 155.

The face member 128 may further include one or more projections 165 that extend rearwardly from the rear side 127 and engage the rear member 130. In the embodiment illustrated in FIGS. 1-7, the face member 128 has two projections 165 extend rearwardly from the rear surface 131 of the face 112 within the recess 155 and beneath the wall 161. One of the projections 165 is located proximate the heel 120, and the other projection 165 is located proximate the toe 122. In other embodiments. The projections 165 may be located in the enlarged sections 156 of the cavity 155 in one embodiment. The projections 165 are configured to be received in receivers 139 in the rear member 130 in one embodiment, to connect the front member 128 and the rear member 130, as described in greater detail below. Additionally, the projections 165 are formed as cylindrical posts in the embodiment illustrated in FIGS. 1-7, however in other embodiments, the projections 165 may be differently configured. For example, the projections 165 may have a different height or cross-sectional shape, and/or the projections 165 may include locking structures, such as flanges, tabs, recesses, etc., to engage structures on the rear member 130 in complementary manner. In other embodiments, the face member 128 may include a smaller or greater number of projections 165 (including the absence of the projections 165 in one embodiment), and/or the projections 165 may be differently located and oriented.

The ball striking device 100 may include a shaft 104 connected to or otherwise engaged with the ball striking head 102, as shown in FIG. 1. The shaft 104 is adapted to be gripped by a user to swing the ball striking device 100 to strike the ball. The shaft 104 can be formed as a separate piece connected to the head 102, such as by connecting to the hosel 109, as described above. In other embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some exemplary embodiments, the shaft 104, or at least portions thereof, may be constructed of a metal, such as stainless steel, or a composite, such as a carbon/graphite fiber-polymer composite. However, it is contemplated that the shaft 104 may be constructed of different materials without departing from the scope of the invention, including conventional materials that are known and used in the art.

Figure 2:
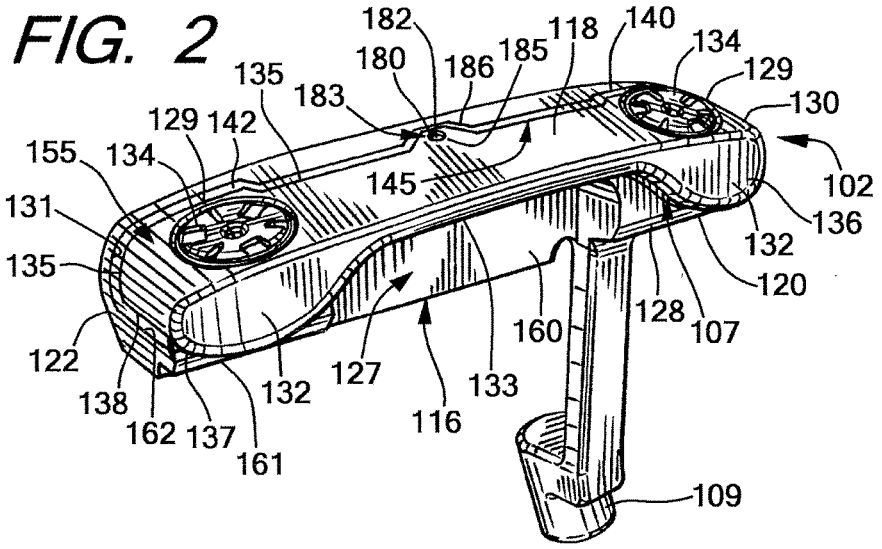
FIG. 2 is a bottom rear perspective view of the ball striking device of FIG. 1.
Figure 3:
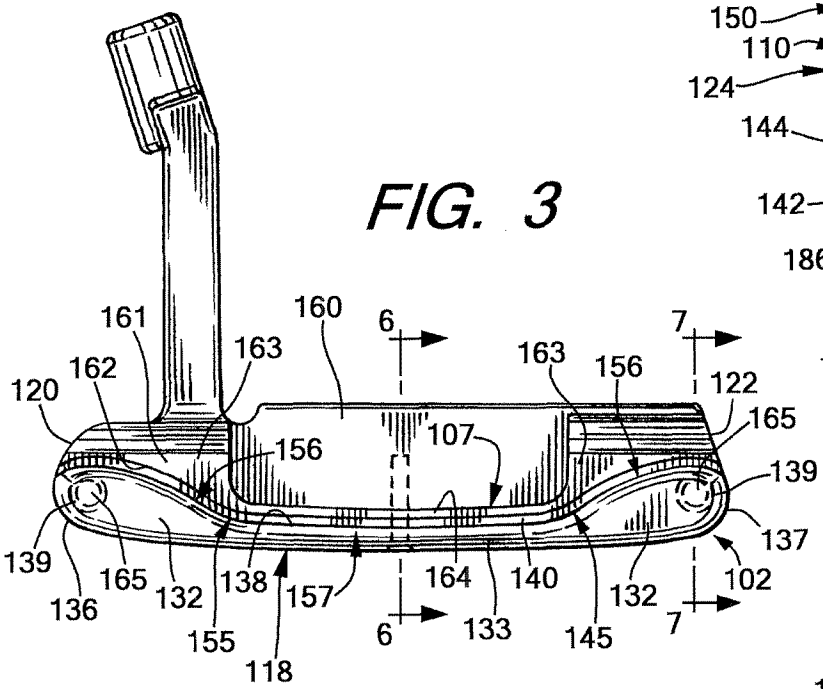
FIG. 3 is a rear view of the ball striking device of FIG. 1.

In general, the head 102 of the ball striking device 100 has a rear member 130 (which may also be referred to as a "weight member") connected to the face member 128 at the rear side 127 of the face member 128, and the rear member 130 has a front surface 135 that faces and confronts the rear surface 131 of the face member 128. In general, the rear member 130 is configured to transfer energy and/or momentum to the face member 128 upon impact of the ball on the striking surface 110, including an off-center impact. The top surface 138 of the rear member 130 may also confront and/or be at least partially covered by the underside 162 of the wall 161 of the face member 128, such as in the embodiment of FIGS. 1-7. For example, the wall 161 may cover a front portion of the top surface 138 of the rear member 130, as in the embodiment of FIGS. 1-7, or may cover the entire top surface 138 in another embodiment. In one embodiment, the face member 128 and the rear member 130 follow generally the same outer periphery around the heel 120, sole 118, and toe 122 of the head 102, as illustrated in FIGS. 1-3, however in other embodiments, the outer peripheries of these members 128, 130 may be different.

The rear member 130 may have one or more receivers 139 that are configured to receive and/or engage the projections 165 of the face member 128 to assist in retaining the face member 128 and the rear member 130 together. The receivers 139 may be dimensioned in a complementary manner with the projections 165, and may be equal in number to the projections 165. In the embodiment of FIGS. 1-7, the rear member 130 has two receivers 139 in the front surface 135, with one receiver 139 proximate the heel edge 136 and one receiver 139 proximate the toe edge 137. The receivers 139 in this embodiment are also located within the perimeter weighting portions 132, and are in the form of cylindrical holes that extend rearwardly from the front surface 135, a portion of the way through the rear member 130. In other embodiments, the receivers 139 may be different in number, size, shape, orientation, and/or location, and it is understood that different configurations of projections 165 may dictate different configurations of receivers 139, and vice-versa. As described above, each projection 165 and respective receiver 139 may include complementary retaining structure, such as tabs, slots, ridges, or other interlocking structure, which may have resilient components. It is understood that no receivers 139 may be necessary if the face member 128 includes no projections 165. FIG. 8 illustrates an embodiment where the head 102 has no projections 165 or receivers 139, such that the front surface 135 of the rear member 130 and the rear surface 131 of the face member 128 have flat surfaces confronting each other proximate the heel 120 and the toe 122, and is otherwise similar or identical to the head 102 of FIGS. 1-7. In a further embodiment, the orientations and locations of the projections 165 and the receivers 139 may be transposed, such that one or more of the projections 165 may be located on the rear member 130 and one or more of the receivers 139 may be located on the face member 128. In still further embodiments, the rear member 130 and the face member 128 may include a different type of complementary interlocking structure.

The rear member 130 may be connected to the face member 128 in a number of different configurations that permit energy and/or momentum transfer between the rear member 130 and the face member 128, several of which are described below and shown in the FIGS. In other embodiments, the rear member 130 may be differently configured, and/or the head 102 may contain multiple rear members 130. For example, the rear member 130 as shown in FIGS. 1-7 may be divided into two, three, or more separate rear members 130 in another embodiment, which may be connected to the face member 128 in similar or different configurations. The rear member 130 in all embodiments may affect or influence the center of gravity of the head 102. Additionally, the rear member 130 (and other weight members described herein) may be made of any of a variety of different materials, which may be selected based on their weight or density. For example, the rear member 130 may be made from a metallic material such as stainless steel and/or tungsten, or may be made from other materials, for example polymers that may be doped with a heavier material (e.g. tungsten). The rear member 130 may also include portions that may be more heavily weighted than others, and may include weighted inserts or other inserts. In one embodiment, the rear member 130 has weights 134 in the perimeter weighting portions 132, which are illustrated in this embodiment to be removable threaded weights that are received in openings 129 in the sole 118, as shown in FIGS. 2 and 4. The weights 134 may have different weight characteristics in one embodiment, such as different densities and/or geometries, to provide different weighting configurations. Each weight 134 may also be removable and interchangeable with another weight 134 having a different weighting characteristic. For example, the weights 134 can be used to shift the CG of the rear member 130 and/or the entire head 102 toward the heel 120 or the toe 122, or can be used to increase or decrease the overall weight of the rear member 130 and/or the entire head 102, among other uses. In one embodiment, the use of the weights 134 to alter the weight of the rear member 130 allows the ratio between the weights of the face member 128 and the rear member 130 to be controlled. Further weighting configurations are recognizable to those skilled in the art. It is understood that the weights 134 may not be present in another embodiment, or the weights 134 may be in a different form in a further embodiment, such as molded weights (e.g., doped polymers).

In the embodiment of FIGS. 1-7, the rear member 130 is separated from the face member 128 by a resilient member 145 at least partially formed of the resilient material 140. In this embodiment, the rear member 130 may be considered to be suspended with respect to the face member 128, at least partially by the resilient material 140 in this configuration. It is understood that an adhesive or other bonding material may be utilized to connect the resilient material 140 to the face member 128 and/or the rear member 130, and that other connection techniques may be used in other embodiments, such as mechanical fasteners, interlocking designs (e.g. dovetail, tab and slot, etc.) and others. The resilient material 140 may be connected to the face member 128, the rear member 130, or both, in various embodiments. The resilient material 140 may be a natural or synthetic rubber material, a polyurethane-based elastomer, or other elastomeric material in one embodiment, but may be a different type of resilient material in another embodiment, including various types of resilient polymers, such as foam materials or other rubber-like materials. Additionally, the resilient material 140 may have at least some degree of resiliency, such that the resilient material 140 exerts a response force when compressed, and can return to its previous state following compression. The resilient material 140 may have a strength or hardness that is lower than, and may be significantly lower than, the strength/hardness of the material of the face member 128 and/or the rear member 130. In one embodiment, the resilient material 140 may have a hardness of from 30-90 Shore A or approximately 30-90 Shore A. In another embodiment, the resilient material 140 may have a hardness of approximately 50-70 Shore A. The hardness may be determined, for example, by using ASTM D-2240 or another applicable test with a Shore durometer. In an example embodiment, the resilient material 140 may be a polyurethane-based elastomer with a hardness of approximately 65 Shore A. Further, in one embodiment, the resilient material may have compression properties (based on a 0.56 shape factor and determined using ASTM D-575) as follows: 30 psi for 5% deflection, 70 psi for 10% deflection, 110 psi for 15% deflection, 160 psi for 20% deflection, and 220 psi for 25% deflection.

The properties of the resilient material, such as hardness and/or resiliency, may be designed for use in a specific configuration. For example, the hardness and/or resiliency of the resilient material 140 may be designed to ensure that an appropriate rebound or reaction force is transferred to the face, which may be influenced by parameters such as material thickness, mass of various components (including the rear member 130 and/or the face member 128), intended use of the head 102, and others. The hardness and resiliency may be achieved through techniques such as material selection and any of a variety of treatments performed on the material that can affect the hardness or resiliency of the resilient material, as discussed elsewhere herein. The hardness and thickness of the resilient material may be tuned to the weight of a particular rear member 130. For example, heavier weights may require harder resilient material 140, and lighter weights may require softer resilient material 140. Using a thinner resilient material 140 may also necessitate the use of a softer material, and a thicker resilient material 140 may be usable with harder materials. In a configuration where the resilient material 140 is a polyurethane-based material having a hardness of approximately 65 Shore A, the resilient material 140 may have a thickness between the rear member 130 and the rear surface 131 of the face member 128 of approximately 5 mm in one embodiment, or approximately 3 mm in another embodiment.

In the embodiment shown in FIGS. 1-7, the resilient member 145 may be formed as a single, integral piece of the resilient material 140; however the resilient member 145 may be formed of separate pieces in various embodiments. The resilient member 145 and/or the resilient material 140 may be formed of multiple components as well, including components having different hardness in different regions, including different hardness distributions. For example, the resilient member 145 and/or the resilient material 140 may be formed of an exterior shell that has a different (higher or lower) hardness than the interior, such as through being made of a different material (e.g. through co-molding) and/or being treated using a technique to achieve a different hardness. Examples of techniques for achieving a shell with a different hardness include plasma or corona treatment, adhesively bonding a film to the exterior, coating the exterior (such as by spraying or dipping). If a cast or other polyurethane-based material is used, the resilient material 140 may have a thermoplastic polyurethane (TPU) film bonded to the exterior, a higher or lower hardness polyurethane coating applied by spraying or dipping, or another polymer coating (e.g. a thermoset polymer), which may be applied, for example, by dipping the resilient material into an appropriate polymer solution with an appropriate solvent. Additionally, the resilient member 145 and/or the resilient material 140 may have different hardness or compressibility in different lateral or vertical portions thereof, which can create different energy and/or momentum transfer effects in different locations. For example, the resilient member 145 and/or the resilient material 140 may have a higher or lower hardness in proximate the heel 120 and/or the toe 122, which may be achieved by techniques described herein, such as treatments or use of different materials and/or separate pieces. In this configuration, the hardness of the resilient material 140 may be customized for use by a particular golfer or a particular golfer's hitting pattern. Similarly, an asymmetrical resilient member 145 may also be used to create different energy and/or momentum transfer effects, by providing a larger or smaller amount of material at specific portions of the face member 128. Such an asymmetrical resilient member 145 may also be used to provide customizability. A variable-hardness or asymmetrical resilient member 145 may also be used in conjunction with an offset connection point, as discussed below, for further customizability. Other embodiments described herein may also employ a resilient material 140 that has a variable hardness or asymmetrical features. A single-component or multi-component resilient member 145 and/or resilient material 140 may be manufactured by co-molding, and may be co-molded in connection with the face member 128 and/or the rear member 130.

Figure 7:
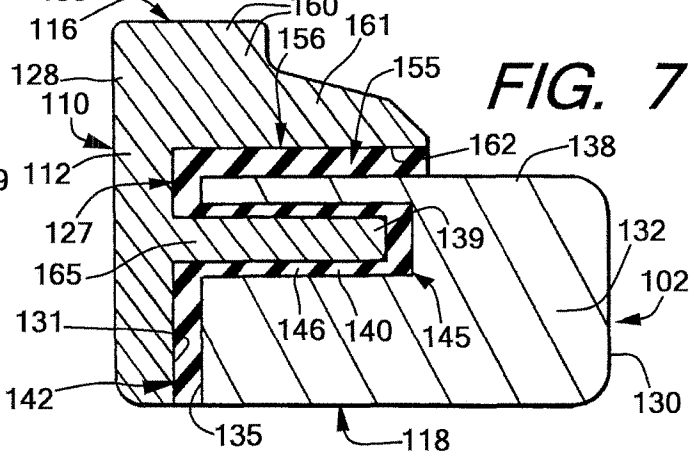
FIG. 7 is a cross-section view taken along line 7-7 of FIG. 3.
Figure 8:
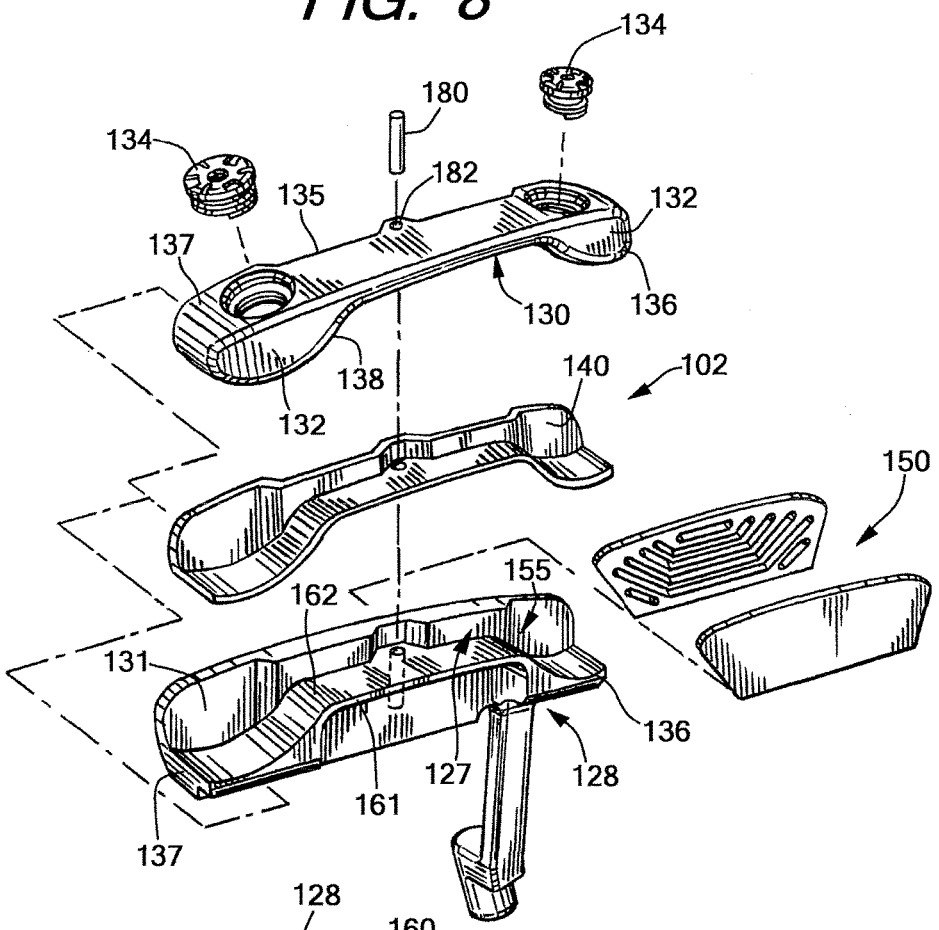
FIG. 8 is a bottom rear perspective exploded view of another embodiment of a ball striking device according to aspects of the present invention, in the form of a golf putter.

As seen in FIGS. 1-7, the resilient material 140 is connected between the rear member 130 and the face member 128. In one embodiment, the rear member 130 has at least one surface that is engaged by the resilient material 140 and at least one other surface that is exposed and not engaged by the resilient material 140. In the embodiment of FIGS. 1-7, the front surface 135 and the top surface 138 of the rear member 130 are engaged by the resilient material 140, and the underside and rear side of the rear member 130 are exposed and not engaged by the resilient material 140. As shown in FIGS. 6-7, the resilient material 140 is sandwiched between the rear surface 131 on the rear side 127 of the face member 128 and the front surface 135 of the rear member 130 and is also sandwiched between the underside 162 of the wall 161 and the top surface 138 of the rear member 130. The rear member 130 is spaced from the face member 128, and the resilient material 140 at least partially fills the spaces 142 between the front surface 135 of the rear member 130 and the rear side 127 of the face member 128 and between the underside 162 of the wall 161 and the top surface 138 of the rear member 130. Additionally, in the embodiment of FIGS. 1-7, the resilient material 140 also covers the projections 165 of the face member 128 and is positioned between the projections 165 and the inner walls of the receivers 139 of the rear member 130. The resilient material 140 in FIGS. 1-7 is illustrated as a single-piece resilient member 145 that includes tube members 146 that receive the projections 165 and are received in the receivers 139. However, in other embodiments, separate tube members 146 may be provided that are formed of a separate piece from the remainder of the resilient member 145. In the embodiment illustrated in FIGS. 1-7, the resilient material 140 is substantially flush with the outer peripheries of the face member 128 and the rear member 130 around the entire periphery of the face member 128. In other embodiments, the face member 128, the rear member 130, and/or the resilient material 140 (or portions of such members) may not be flush or substantially flush around at least a portion of the periphery of the head 102. The resilient material 140 may be positioned on both opposite lateral sides of the center of gravity (CG) of the face member 128. In one embodiment, as shown in FIGS. 6-7, the resilient material 140 completely or substantially completely fills the spaces 142 between the rear member 130 and the face member 128. In another embodiment, may have a resilient material 140 that partially fills the spaces 142 between the face member 128 and the rear member 130, such as the resilient material 140 being positioned between the face member 128 and the rear member 130 at least at the heel 120 and the toe 122.

The rear member 130 may have various different dimensions and structural properties in various embodiments. In the embodiment shown in FIGS. 1-7, the rear member 130 has a heel edge 136 and a toe edge 137, with a lateral width defined between the heel and toe edges 136, 137. The lateral width of the rear member 130 is the same or approximately the same as the lateral width of the face member 128, measured between the heel 120 and toe 122. Additionally, the rear member 130 has its mass distributed proportionally more toward the heel and toe edges 136, 137, and has a thickness and a cross-sectional area that are greater at or around the heel and toe edges 136, 137 than at the CG of the rear member 130. In other words, the rear member 130 includes two perimeter weighting portions 132 at the heel and toe edges 136, 137 and a recessed portion or thinned portion 133 proximate the center of the rear member 130. This configuration can achieve greater perimeter weight distribution and increased moment of inertia for the club head 102. Further, the rear member 130 may be positioned so that the CG of the rear member 130 is substantially aligned with the CG of the face member 128. In one embodiment, the CGs of the rear member 130 and the face member 128 are laterally aligned, and these respective CGs may additionally or alternately be vertically aligned in another embodiment. In one embodiment, the face member 128 may have alignment indicia (not shown) aligned with the CG of the face member 128 and/or the CG of the rear member 130, however this indicia may be absent or differently located in other embodiments.

The rear member 130 may have varying sizes in different embodiments. For example, in one embodiment, the rear member 130 may make up about 25% or more of the total weight of the head 102, or about 25-45% of the total weight of the head 102 in another embodiment. In an example embodiment, the total weight of the head 102 may be about 340 g, with the rear member 130 having a weight of about 100 g.

In one embodiment, the club head 102 may include an engagement member 180 that rigidly engages both the face member 128 and the rear member 130 to form a point of rigid engagement 181 between the face member 128 and the rear member 130. The engagement member 180 may be the sole point or area of rigid engagement between the face member 128 and the rear member 130 in one embodiment. For example, in the embodiments of FIGS. 1-12, the engagement member 180 forms the sole area of rigid engagement between the face member 128 and the rear member 130, as the resilient material 140 completely separates the face member 128 from the rear member 130. In other embodiments, there may be multiple areas of rigid engagement between the face member 128 and the rear member 130, such as by use of multiple engagement members 180, or there may be no points of rigid engagement between the face member 128 and the rear member 130, such as if the club head 102 is not provided with an engagement member. It is understood that "rigid" engagement as defined herein does not necessary imply any fixing or attachment, but instead, means that the surfaces engaging each other are rigid, rather than flexible, and behave rigidly during energy and/or momentum transfer. For example, the engagement member 180 illustrated in FIGS. 4-6 may rigidly engage the face member 128 and/or the rear member 130 through non-fixed pin/hole engagement.

The engagement member 180 may have various structural configurations, locations, and orientations. In various embodiments, the engagement member 180 may be fixed to at least one of the face member 128 and the rear member 130, and/or the engagement member may rigidly abut at least one of the face member 128 and the rear member 130 (but without being fixedly connected). In the embodiment illustrated in FIGS. 1-7, the engagement member 180 is in the form of a pin that extends upwardly through at least a portion of the rear member 130 and at least a portion of the face member 128 to connect the rear member 130 to the face member 128. The engagement member (pin) 180 in this embodiment extends through an aperture 182 in the rear member 130 and is received within a receiver 184 in the face member 128. In one embodiment, the engagement member 180 is non-fixedly connected to the face member 128 and/or the rear member 130, and may be fixedly connected to one of the face member 128 or the rear member 130, but not both. This configuration permits the engagement member 180 to form a joint 183 between the face member 128 and the rear member 130, which in turn permits the rear member 130 to transfer energy and/or momentum to the face member 128 through the resilient material 140, as described below. In the embodiment of FIGS. 1-7, the engagement member 180 is fixedly connected to the face member 128 (e.g., via threading connection) and is non-fixedly engaged with the rear member 130, while rigidly engaging both the face member 128 and the rear member 130. The engagement member 180 may have an enlarged head that engages the rear member 130 in one embodiment, and the aperture 182 may be countersunk to receive the enlarged head, as shown in FIG. 6. The rear member 130 may include a lip 185 that extends forward from the front surface 135 of the rear member 130, which includes the aperture 182 in one embodiment, as shown in FIGS. 2 and 4-6. The face member 128 may include an indent 186 to receive the lip 185, as also illustrated in FIGS. 2 and 4-6.

In the embodiment of FIGS. 1-7, the resilient material 140 includes a gap 144 allowing the engagement member 180 to extend through the resilient material 140 to engage both the face member 128 and the rear member 130. The resilient member 140 may further include contours and surfaces to cover and separate the surfaces of the lip 185 and the indent 186. Additionally, in the embodiment of FIGS. 1-7, the engagement member 180 is located approximately at a midpoint between the heel and toe 120, 122 and also approximately at a midpoint between the heel and toe edges 136, 137 of the rear member 130. In this location, the engagement member 180 and the joint 183 are also approximately aligned laterally with the CG of the face member 128, the rear member 130, and/or the club head 102 as a whole. The engagement member 180 may also be vertically aligned with the CG of one or more of these components, in a further embodiment. In other embodiments, the engagement member 180 may have a different orientation, structure, or location.

Figure 9:
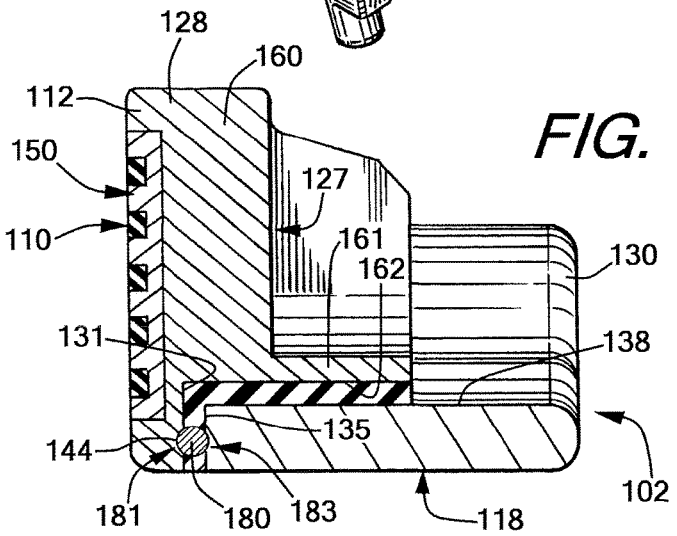
FIG. 9 is a cross-section view of another embodiment of a ball striking device according to aspects of the present invention, in the form of a golf putter.

FIG. 9 illustrates another embodiment of an engagement member 180 that forms a point or area of rigid engagement 181 between the face member 128 and the rear member 130. In this embodiment, the engagement member 180 is in the form of a sphere (e.g., a ball bearing) that is not fixedly connected to either the rear surface 131 of the face member 128 or the front surface 135 of the rear member 130. Instead, this engagement member 180 abuts both of these surfaces. The engagement member 180 in this embodiment is located in generally the same lateral position as the engagement member 180 in FIGS. 1-7, as described above. Other embodiments of engagement members 180 that may be usable in connection with the head 102 described herein include a projection that is fixed to the rear surface 131 of the face member 128 (i.e., the rear of the face portion 160) and abuts the front surface 135 of the rear member 130, but the engagement member 180 is not fixed or otherwise connected to the rear member 130. Such a projection may also be transposed, i.e., by being fixed to the front surface 135 of the rear member 130 and abutting the rear surface 131 of the face member. The projection may have various shapes, such as a domed projection, a wedge-shaped projection, a conical or pyramidal projection, etc. Additional configurations of engagement members 180 may be utilized in other embodiments. Further, engagement members 180 according to these additional embodiments may be considered to define a joint 183 between the face member 128 and the rear member 130, as described above.

Figure 10:
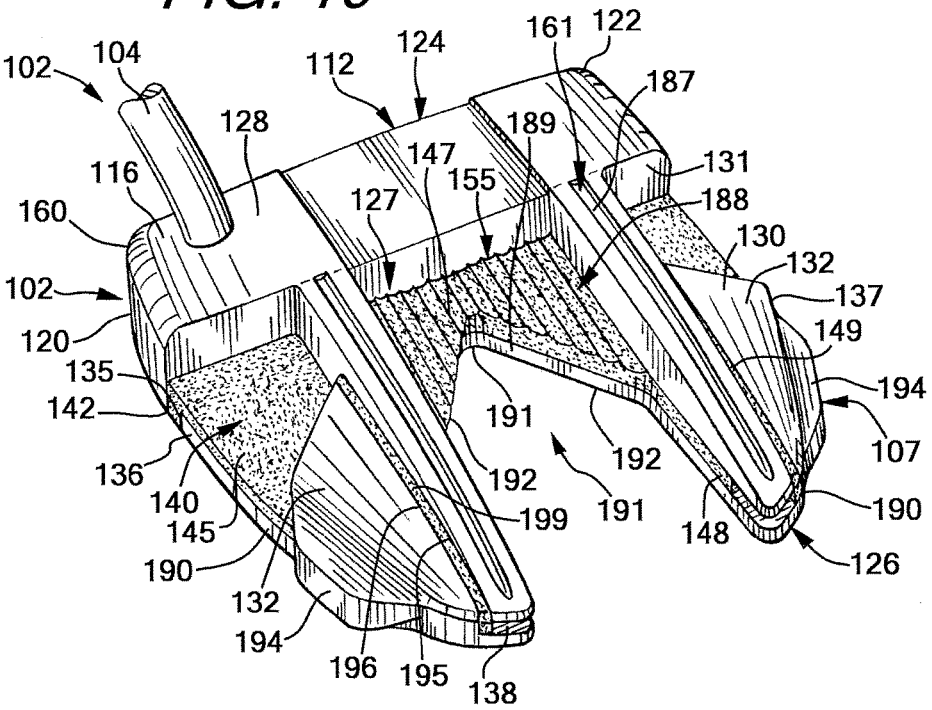
FIG. 10 is a top rear perspective view of another embodiment of a ball striking device according to aspects of the present invention, in the form of a golf putter.
Figure 11:
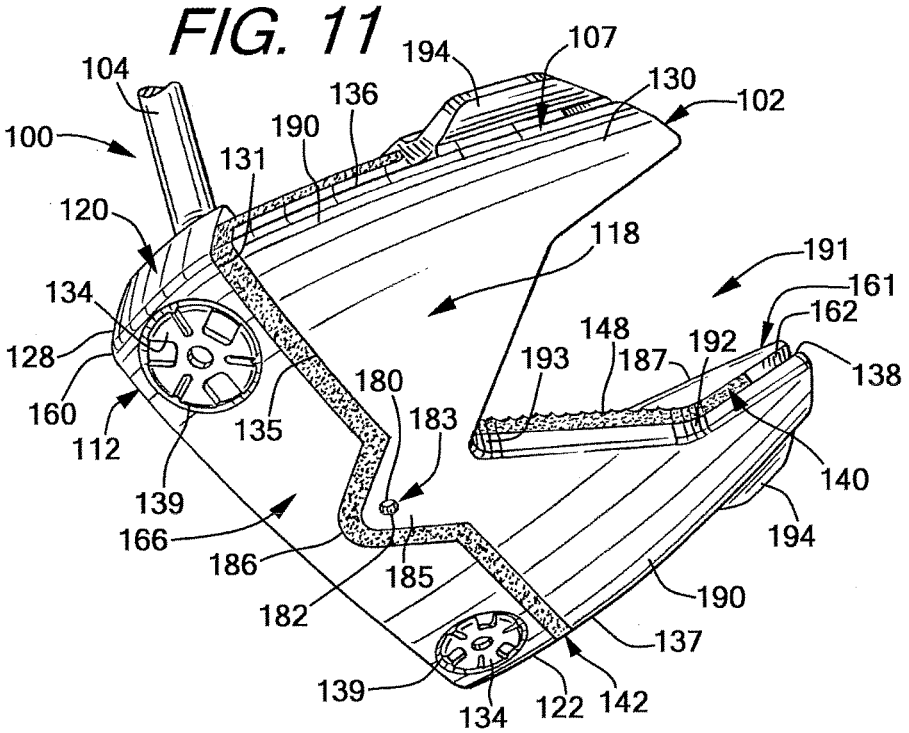
FIG. 11 is a bottom rear perspective view of the ball striking device of FIG. 10.
Figure 12:
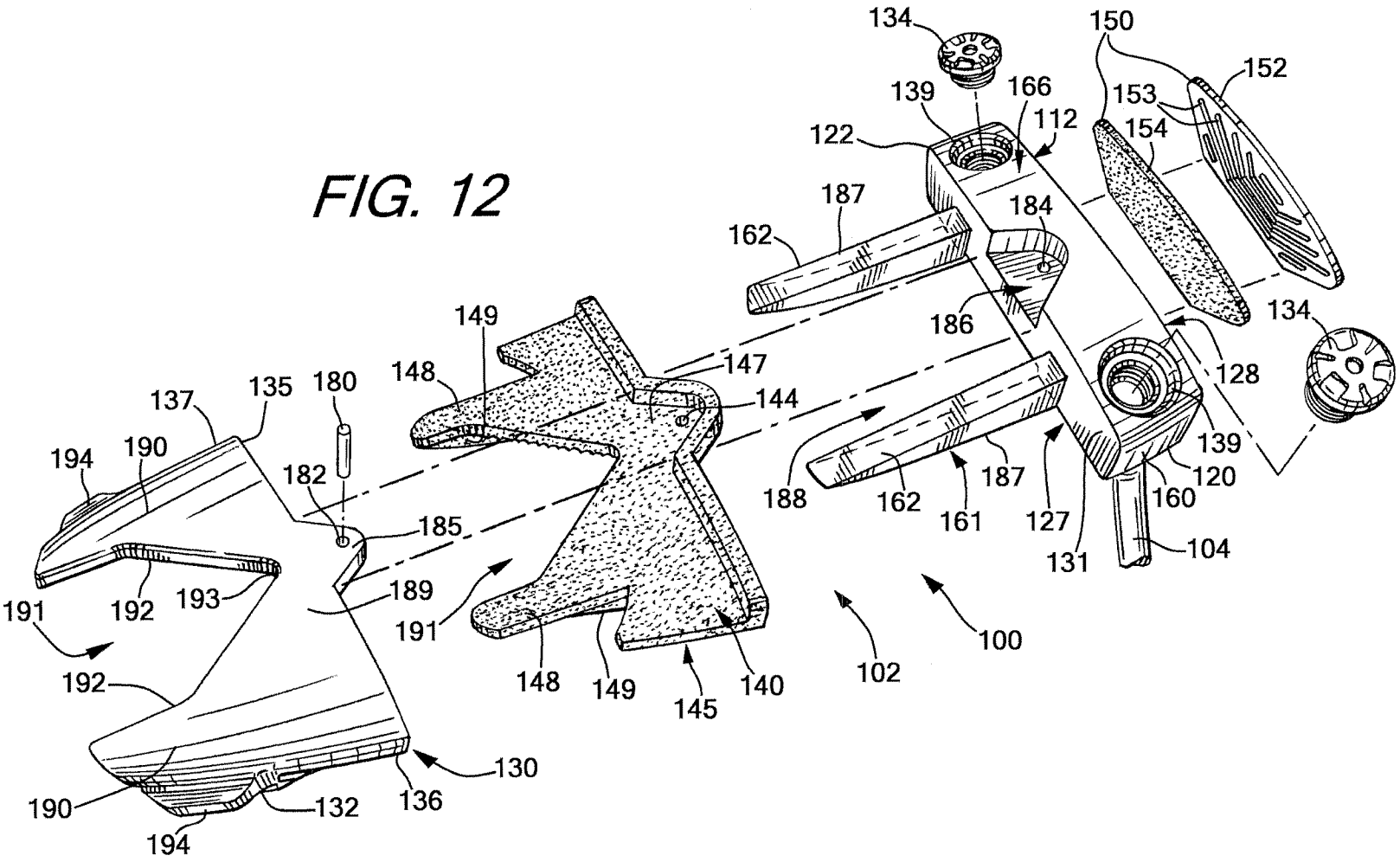
FIG. 12 is a bottom rear perspective exploded view of the ball striking device of FIG. 10.

FIGS. 10-12 illustrate another embodiment of a ball striking device 100 in the form of a golf putter, in accordance with at least some examples of this invention. The ball striking device 100 in FIGS. 10-12 includes a ball striking head 102 and a shaft 104 connected to the ball striking head 102 and extending therefrom, and includes many components in common with the embodiment described herein with respect to FIGS. 1-7. Any such common components in FIGS. 10-12 are referenced in the drawings using similar reference numbers, and such similar components that have already been described above may not be described again with respect to this embodiment for the sake of brevity. It is understood that the embodiment of FIGS. 10-12 may include any of the components and/or features described herein with respect to FIGS. 1-9, and vice versa.

The head 102 in FIGS. 10-12 has a face member 128 that includes the face 112, a rear member 130 connected to the face member 128, and a resilient material 140 positioned between the face member 128 and the rear member 130, as described above. The face member 128 and the rear member 130 are connected by an engagement member 180, which forms a joint 183 and a sole point of rigid connection between these two components. In the embodiment illustrated in FIGS. 10-12, the engagement member 180 is in the form of a pin that extends upwardly through at least a portion of the rear member 130 and at least a portion of the face member 128 to connect the rear member 130 to the face member 128, which is configured similarly to the engagement member 180 shown in FIGS. 1-7 and described elsewhere herein. The rear member 130, the face member 128, and the resilient material 140 in this embodiment include additional connecting structure related to the engagement member 180 as also described elsewhere herein, including an aperture 182, a receiver 184, a lip 185, an indent 186, a gap 144, etc. Additionally, the engagement member 180 in this embodiment is located in generally the same lateral position (i.e., relative to the heel 120 and toe 122) as the engagement member 180 in FIGS. 1-7, as described herein.

The rear side 127 of the face member 128, the rear member 130, and the resilient material 140 in the embodiment of FIGS. 10-12 have shapes and configurations that are different from the embodiment described above. The face member 128 in this embodiment includes a rearwardly-extending portion or wall 161 that extends rearwardly from the face portion 160, which is configured differently from the wall 161 of FIGS. 1-7. In the embodiment of FIGS. 10-12, the rearwardly-extending portion 161 is in the form of two arms 187 extending rearwardly from the face portion 160, such that the rear member 130 is positioned below the undersides 162 of the arms 187. The arms 187 are illustrated as having curved top surfaces that are curved downwardly, such that the height of each arm 187 is tapered to decrease from front 124 to rear 126. Additionally, the arms 187 in this embodiment are completely separate and spaced from each other, and a space 188 is defined between the arms 187. One or more recesses 155 are defined below the arms 187, as well as between the arms 187 and on the heel and toe sides of the arms 187 in this embodiment. In another embodiment, a wall or other bridging member may extend rearwardly between the arms 187 and/or outside the arms (i.e., toward the heel 120 and toe 122) to further define the recess 155 below the arms 187 and below the wall in another embodiment. Other configurations may be used in other embodiments. The rear surface 131 of the face member 128 below the arms 187 is flat in this embodiment, similar to the embodiment of FIG. 8. In another embodiment, the face member 128 and the rear member 130 may include complementary engaging structures such as the projections 165 and recesses 139 illustrated in FIGS. 1-7.

In the embodiment of FIGS. 10-12, the face member 128 has a sole portion 166 that is larger and wider (front to rear) as compared to the face member 128 in FIGS. 1-7. The face member 128 and the rear member 130 combine to define the sole 118 of the club head 102 in this embodiment. Additionally, the weights 134 in this embodiment are connected to the face member 128, rather than the rear member 128. As illustrated in FIGS. 11-12, the weights 134 are removable threaded weights that are received in openings 129 in the sole portion 166 of the face member 128. Other types and configurations of weights 134 may be alternately used, as described herein. In other embodiments, the weights 134 may be connected to the rear member 130, or both the face member 128 and the rear member 130 may have weights 134 connected thereto. Further, the face member 128 in this embodiment has the shaft 104 connected directly to the top side of the face member 128, and has no hosel or similar structure. In another embodiment, the face member 128 may contain a hosel 109 for connection to the shaft 109, as described herein. The face member 128 in this embodiment has further structures already described herein with respect to the embodiments of FIGS. 1-9. For example, the face member 128 has a face insert 150 as described herein.

The rear member 130 in the embodiment of FIGS. 10-12 has a structure that includes a base portion 189 and two legs 190 extending rearwardly from the base portion 189, with a void 191 defined between the legs 190. The void 191 in this embodiment is generally V-shaped, with inner edges 192 that angle toward each other (i.e., inwardly) from the rear 126 toward the front 124, meeting at an interface area 193. The legs 190 in the embodiment of FIGS. 10-12 have perimeter weighting portions 132 on the heel side 136 and the toe side 137 that are raised with respect to the other portions of the rear member 130, such that the perimeter weighting portions 132 extend upward above the undersides 162 of the arms 187. The other portions of the rear member 130 may be considered to be a recessed portion or thinned portion 133 with respect to the perimeter weighting portions 132 in this embodiment. Additionally, in this embodiment, each of the perimeter weighting portions 132 has a wing 194 extending outwardly on the heel 120 or toe 122 sides, which provides additional perimeter weighting. The combinations of the void 191 and the perimeter weighting portions 132 create increased perimeter weighting of the rear member 130 in this embodiment. The rear member 130 is positioned generally below the arms 187 of the face member 128, such that the arms 187 cover at least a portion of the rear member 130. In this configuration, spaces 142 are defined between the front surface 135 of the rear member 130 and the rear side 127 of the face member 128 and between the undersides 162 of the arms 187 and the top surface 138 of the rear member 130. Spaces 142 are additionally defined between the outer surfaces 195 of the arms 187 and the inner surfaces 196 of the perimeter weighting portions 132 of the rear member 130.

The resilient material 140 in the embodiment of FIGS. 10-12 is formed as a resilient member 145 that at least partially fills the spaces 142 between the front surface 135 of the rear member 130 and the rear side 127 of the face member 128, between the undersides 162 of the arms 187 and the top surface 138 of the rear member 130, and between the outer surfaces 195 of the arms 187 and the inner surfaces 196 of the perimeter weighting portions 132 of the rear member 130. In this embodiment, the resilient member 140 has a shape that is similar to that of the rear member 130, having two legs 148 extending rearwardly from a base member 147, such that the void 191 is also defined between the legs 148 of the resilient material 140. The resilient material 140 further has fins 149 extending upwardly from the legs 148, to at least partially fill the spaces 142 between the outer surfaces 195 of the arms 187 and the inner surfaces 196 of the perimeter weighting portions 132. The top side of the resilient material 140 is exposed in several places in this embodiment, as seen in FIG. 10. In another embodiment, as mentioned above, the face member 128 may include one or more walls extending rearwardly and at least partially covering these portions of the resilient material 140.

The rear member 130 in any of the embodiments described herein may be configured such that energy and/or momentum can be transferred between the rear member 130 and the face member 128 during impact, including an off-center impact on the striking surface 110. The resilient material 140 can serve to transfer energy and/or momentum between the rear member 130 and the face member 128 during impact. Additionally, the rear member 130 may also be configured to resist deflection of the face member 128 upon impact of the ball on the striking surface 110. The resiliency and compression of the resilient material 140 permits this transfer of energy and/or momentum from the rear member 130 to the face member 128. As described above, the momentum of the rear member 130 compresses the resilient material 140, and causes the resilient material 140 to exert a response force on the face member 128 to achieve this transfer of momentum. The resilient material 140 may exert at least a portion of the response force on the face member 128 through expansion after the compression. The rear member 130 may deflect slightly toward the impact point to compress the resilient material 140 in the process of this momentum transfer. The actions achieving the transfer of momentum occur between the beginning and the end of the impact, which in one embodiment of a golf putter may be between 4-5 ms. In the embodiments as shown in FIGS. 1-12, the rear member 130 may transfer a greater or smaller amount of energy and/or momentum depending on the location of the impact on the striking surface 110. For example, upon an off-center impact of the ball centered on the heel side 120, the face member 128 tends to deflect rearwardly at the heel 120. As another example, upon an off-center impact of the ball centered on the toe side 122, the face member 128 tends to deflect rearwardly at the toe 122. As the face member 128 begins to deflect rearwardly, at least some of the forward momentum of the rear member 130 is transferred to the face member 128 during impact to resist this deflection. During a heel-side impact, at least some of the momentum transferred to the face member 128 may be transferred from the heel edge 136 of the rear member 130 during impact. Likewise, on a toe-side impact, at least some of the momentum transferred to the face member 128 may be transferred from the toe edge 137 of the rear member 130 during impact. Generally, at least some of the momentum is transferred toward the impact point on the face 112.

The resilient material 140 can function to transfer the energy and/or momentum of the rear member 130 to the face member 128 at the heel 120 or toe 122. In the process of transferring energy and/or momentum during impact, the resilient material 140 may be compressed by the momentum of the rear member 130 and expand to exert a response force on the face member 128, which resists deflection of the face member 128 as described above. It is understood that the degree of potential moment causing deflection of the face member 128 may increase as the impact location diverges from the center of gravity of the face member 128. In one embodiment, the energy and/or momentum transfer from the rear member 130 to the face member 128 may also increase as the impact location diverges from the center of gravity of the face member 128, to provide increased resistance to such deflection of the face member 128. In other words, the energy and/or momentum transferred from the rear member 130 to the face member 128, and the force exerted on the face member 128 by the rear member 130, through the resilient material 140, may be incremental and directly relative/proportional to the distance the impact is made from the optimal impact point (e.g. the lateral center point of the striking surface 110 and/or the CG of the face member 128, in exemplary embodiments). Thus, the head 102 will transfer the energy and/or momentum of the rear member 130 incrementally in the direction in which the ball makes contact away from the center of gravity of the head 102, via the rear member 130 suspended by the resilient material 140. The transfer of energy and/or momentum between the rear member 130 and the face member 128 can reduce the degree of twisting of the face 112 and keep the face 112 more square upon impacts, including off-center impacts. Additionally, the transfer of energy and/or momentum between the rear member 130 and the face member 128 can minimize energy loss on off-center impacts, resulting in more consistent ball distance on impacts anywhere on the face 112. The resilient material 140 may have some elasticity or response force that assists in transferring energy and/or momentum between the rear member 130 and the face member 128.

It is understood that any of the embodiments of ball striking devices 100, heads 102, face members 128, rear members 130, and other components described herein may include any of the features described herein with respect to other embodiments described herein, including structural features, functional features, and/or properties, unless otherwise noted. It is understood that the specific sizes, shapes, orientations, and locations of various components of the ball striking devices 100 and heads 102 described herein are simply examples, and that any of these features or properties may be altered in other embodiments. In particular, any of the connecting members or structures shown and described herein may be used in connection with any embodiment shown herein, to connect the face member 128 and the rear member 130.

Heads 102 incorporating the features disclosed herein may be used as a ball striking device or a part thereof. For example, a golf club 100 as shown in FIG. 1 may be manufactured by attaching a shaft or handle 104 to a head that is provided, such as the head 102 as described above. As another example, a golf club 100 as shown in FIG. 1 may be manufactured by attaching a rear member 130 to a face member that is provided, such as the face member 128 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. In one embodiment, a set of golf clubs can be manufactured, where at least one of the clubs has a head according to one or more embodiments described herein. Such a set may include at least one wood-type club, at least one iron-type club, and/or at least one putter. For example, a set may include one or more wood-type golf clubs and one or more iron-type golf clubs, which may have different loft angles, as well as one or more putters, with each club having a head 102 as described above and shown in FIGS. 1-12. The various clubs in the set may have rear members 130 that may be slightly different in shape, size, location, orientation, etc., based on the loft angle of the club. The various clubs may also have an added weight amount or weight distribution (including CG location) that may be different based on characteristics such as the type and loft angle of the club.

Different rear members 130 and different locations, orientations, and connections thereof, may produce different energy and/or momentum transfer upon impacts on the striking surface 110, et seq., including off-center impacts. Additionally, different rear members 130 and different locations, orientations, and connections thereof, may produce different effects depending on the location of the ball impact on the face 112. Accordingly, one or more clubs can be customized for a particular user by providing a club with a head as described above, with a rear member 130 that is configured in at least one of its shape, size, location, orientation, etc., based on a hitting characteristic of the user, such as a typical hitting pattern or swing speed. Customization may also include adding or adjusting weighting according to the characteristics of the rear member 130 and the hitting characteristic(s) of the user. Still further embodiments and variations are possible, including further techniques for customization.

The ball striking devices described herein may be used by a user to strike a ball or other object, such as by swinging or otherwise moving the head 102 to strike the ball on the striking surface 110 of the face 112. During the striking action, the face 112 impacts the ball, and one or more rear members 130 may transfer energy and/or momentum to the face 112 during the impact, in any manner described above. In one embodiment, the rear member(s) 130 may transfer incrementally greater energy and/or momentum for impacts that are farther from the desired impact point (e.g. the CG). As described below, the devices described herein, when used in this or a comparable method, may assist the user in achieving more consistent accuracy and distance of ball travel, as compared to other ball striking devices.

The various embodiments of ball striking heads with rear members described herein can provide energy and/or momentum transfer upon impacts on the striking face, which can assist in keeping the striking face more square with the ball, particularly on off-center impacts, which can in turn provide more accurate ball direction. Additionally, the energy and/or momentum transfer to the face member can reduce or minimize energy loss on off-center impacts, creating more consistent ball speed and distance. The energy and/or momentum transfer may be incremental based on the distance of the impact away from the desired or optimal impact point. Further, the resilient material and/or the spacer(s) may achieve some energy absorption or damping on center impacts (e.g. aligned with the center point and/or the CG of the face). As a result of the reduced energy loss on off-center hits, reduced twisting of the face on off-center hits, and/or reduced energy transfer on center hits that can be achieved by the heads as described above, greater consistency in both lateral dispersion and distance dispersion can be achieved as compared to typical ball striking heads of the same type, with impacts at various locations on the face. The ball striking heads described herein can also provide dissipation of impact energy through the resilient material, which can reduce vibration of the club head and may improve feel for the user. Still further, the use of the rear member on the bottom side of the head can provide an aesthetic option for the resilient material and/or the rear member to not be visible to the user at the address position. Other benefits can be recognized and appreciated by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a face member including a face having a striking surface configured for striking a ball and a rear side located behind the face, the face member having a first projection extending rearwardly from the rear side of the face member proximate a heel side of the head and a second projection extending rearwardly from the rear side of the face member proximate a toe side of the head, the face member further including a shaft connection structure configured for connection of a golf club shaft;

a rear member connected to the rear side of the face member and having a front surface confronting the rear side of the face member, the rear member having a first receiver in the front surface on the heel side of the head and a second receiver in the front surface on the toe side of the head, wherein the first projection is received in the first receiver and the second projection is received in the second receiver;

an engagement member connecting the face member to the rear member, wherein the engagement member forms a joint between the face member and the rear member, and wherein the engagement member is located between the first and second projections and between the first and second receivers; and a resilient material separating the rear member from the face member, wherein the resilient material engages the rear member and the face member and is configured to transfer momentum between the face member and the rear member.

2. The golf club head of claim 1, wherein the resilient material covers the first and second projections and separates the first and second projections from the first and second receivers.

3. The golf club head of claim 1, wherein the engagement member comprises a pin connected to the face member and received in an aperture in the rear member.

4. The golf club head of claim 1, wherein the rear member has perimeter weighting portions located at the heel side and the toe side of the head and a thinned portion between the perimeter weighting portions, and wherein the first receiver and the second receiver are located in the perimeter weighting portions.

5. A golf club head comprising:

a face member including a face having a striking surface configured for striking a ball and a rear side located behind the face, the face member comprising a face portion at least partially defining the face and a wall extending rearward from the face portion;

a hosel connected to the face member and configured for connection of a golf club shaft;

a rear member connected to the rear side of the face member, wherein the rear member is positioned below the wall, such that the wall covers at least a portion of the rear member, and wherein the rear member forms at least a portion of a sole of the head; and a resilient material separating the rear member from the face member, wherein the resilient material engages the rear member and the face member and is configured to transfer momentum between the face member and the rear member.

6. The golf club head of claim 5, further comprising:

an engagement member connecting the face member to the rear member, wherein the engagement member forms a joint between the face member and the rear member.

7. The golf club head of claim 5, wherein the resilient material is positioned between a front surface of the rear member and a rear surface of the face portion of the face member and between a top surface of the rear member and an underside of the wall.

8. The golf club head of claim 5, wherein the wall covers a front portion of a top surface of the rear member.

9. The golf club head of claim 5, wherein the wall and the face portion of the face member are formed of a single integral piece.

10. A golf club head comprising:

a face member including a face having a striking surface configured for striking a ball and a rear side located behind the face, the face member comprising a face portion at least partially defining the face and a wall extending rearward from the face portion;

a rear member connected to the rear side of the face member, wherein the rear member is positioned below the wall, such that the wall covers at least a portion of the rear member, and wherein the rear member forms at least a portion of a sole of the head; and a resilient material separating the rear member from the face member, wherein the resilient material engages the rear member and the face member and is configured to transfer momentum between the face member and the rear member, wherein the face member further comprises a first projection extending rearwardly from the rear side of the face member proximate a heel side of the head and a second projection extending rearwardly from the rear side of the face member proximate a toe side of the head, and wherein the rear member further comprises a first receiver in a front surface of the rear member on the heel side of the head and a second receiver in the front surface on the toe side of the head, wherein the first projection is received in the first receiver and the second projection is received in the second receiver.

11. The golf club head of claim 10, wherein the rear member has perimeter weighting portions located at the heel side and the toe side of the head and a thinned portion between the perimeter weighting portions, and wherein the first receiver and the second receiver are located in the perimeter weighting portions.

12. The golf club head of claim 10, wherein the resilient material covers the first and second projections and separates the first and second projections from the first and second receivers.

13. A golf club head further comprising:

a face member including a face having a striking surface configured for striking a ball and a rear side located behind the face, the face member comprising a face portion at least partially defining the face and a wall extending rearward from the face portion;

a rear member connected to the rear side of the face member, wherein the rear member is positioned below the wall, such that the wall covers at least a portion of the rear member, and wherein the rear member forms at least a portion of a sole of the head;

a resilient material separating the rear member from the face member, wherein the resilient material engages the rear member and the face member and is configured to transfer momentum between the face member and the rear member; and an engagement member connecting the face member to the rear member, wherein the engagement member forms a joint between the face member and the rear member.

14. The golf club head of claim 13, wherein the engagement member comprises a pin connected to the face member and received in an aperture in the rear member.

15. The golf club head of claim 13, wherein the engagement member is approximately aligned laterally with a center of gravity of the head.

16. The golf club head comprising:

a face member including a face having a striking surface configured for striking a ball and a rear side located behind the face, the face member comprising a face portion at least partially defining the face and a wall extending rearward from the face portion;

a rear member connected to the rear side of the face member, wherein the rear member is positioned below the wall, such that the wall covers at least a portion of the rear member, and wherein the rear member forms at least a portion of a sole of the head; and a resilient material separating the rear member from the face member, wherein the resilient material engages the rear member and the face member and is configured to transfer momentum between the face member and the rear member, wherein the rear member has perimeter weighting portions located at a heel side and a toe side of the head and a thinned portion between the perimeter weighting portions, and wherein the wall follows contours of the rear member to at least partially cover the perimeter weighting portions and the thinned portion.

17. A golf club head comprising:

a face member including a face having a striking surface configured for striking a ball and a rear side located behind the face, the face member comprising a face portion at least partially defining the face and a wall extending rearward from the face portion;

a rear member connected to the rear side of the face member, wherein the rear member is positioned below the wall, such that the wall covers at least a portion of the rear member, and wherein the rear member forms at least a portion of a sole of the head; and a resilient material separating the rear member from the face member, wherein the resilient material engages the rear member and the face member and is configured to transfer momentum between the face member and the rear member, wherein the face member has a recess located on the sole and below the wall, wherein at least a portion of the rear member is received in the recess.

18. A golf club head comprising:

a face member including a face having a striking surface configured for striking a ball and a rear side located behind the face, the face member comprising a face portion at least partially defining the face and a wall extending rearward from the face portion, the face member further having a first projection extending rearwardly from the rear side of the face member proximate a heel side of the head and a second projection extending rearwardly from the rear side of the face member proximate a toe side of the head;

a rear member connected to the rear side of the face member and having a front surface confronting the rear side of the face member, wherein the rear member is positioned below the wall, such that the wall covers at least a portion of the rear member, wherein the rear member forms at least a portion of a sole of the head, wherein the rear member has a first receiver in the front surface on the heel side of the head and a second receiver in the front surface on the toe side of the head, and wherein the first projection is received in the first receiver and the second projection is received in the second receiver;

an engagement member connecting the face member to the rear member, wherein the engagement member forms a joint between the face member and the rear member; and a resilient material separating the rear member from the face member, wherein the resilient material engages the rear member and the face member and is configured to transfer momentum between the face member and the rear member.

19. A golf club head comprising:

a face member including a face having a striking surface configured for striking a ball and a rear side located behind the face, the face member comprising a face portion at least partially defining the face and two arms extending rearward from the face portion, wherein the arms are spaced from each other;

a rear member connected to the rear side of the face member, wherein the rear member is positioned below the arms, such that the arms cover at least a portion of the rear member, and wherein the rear member forms at least a portion of a sole of the head;

a resilient material separating the rear member from the face member, wherein the resilient material engages the rear member and the face member and is configured to transfer momentum between the face member and the rear member.

20. The golf club head of claim 19, further comprising:

an engagement member connecting the face member to the rear member, wherein the engagement member forms a joint between the face member and the rear member.

21. The golf club head of claim 19, wherein the rear member has perimeter weighting portions located at a heel side and a toe side of the head that are raised with respect to other portions of the rear member, and wherein the resilient material further separates outer surfaces of the arms from inner surfaces of the perimeter weighting portions.

22. The golf club head of claim 19, wherein the rear member comprises a base member and two legs extending rearwardly from the base member, wherein a void is defined between the legs.

23. The golf club head of claim 22, wherein the void is V-shaped, and wherein the resilient material also comprises a base member and two legs extending rearwardly from the base member, wherein the void is further defined between the legs of the resilient material.

24. A golf club head comprising:

a face member including a face having a striking surface configured for striking a ball and a rear side located behind the face, the face member having a first projection extending rearwardly from the rear side of the face member proximate a heel side of the head and a second projection extending rearwardly from the rear side of the face member proximate a toe side of the head;

a rear member connected to the rear side of the face member and having a front surface confronting the rear side of the face member, the rear member having a first receiver in the front surface on the heel side of the head and a second receiver in the front surface on the toe side of the head, wherein the first projection is received in the first receiver and the second projection is received in the second receiver;

a resilient material separating the rear member from the face member, wherein the resilient material engages the rear member and the face member and is configured to transfer momentum between the face member and the rear member; and an engagement member connecting the face member to the rear member, wherein the engagement member forms a joint between the face member and the rear member, wherein the engagement member is approximately aligned laterally with a center of gravity of the head.

25. A golf club head comprising:

a face member including a face having a striking surface configured for striking a ball and a rear side located behind the face, the face member having a first projection extending rearwardly from the rear side of the face member proximate a heel side of the head and a second projection extending rearwardly from the rear side of the face member proximate a toe side of the head;

a rear member connected to the rear side of the face member and having a front surface confronting the rear side of the face member, the rear member having a first receiver in the front surface on the heel side of the head and a second receiver in the front surface on the toe side of the head, wherein the first projection is received in the first receiver and the second projection is received in the second receiver; and a resilient material separating the rear member from the face member, wherein the resilient material engages the rear member and the face member and is configured to transfer momentum between the face member and the rear member;

wherein the face member comprises a face portion at least partially defining the face and a wall extending rearward from the face portion, wherein the rear member is positioned below the wall, such that the wall covers at least a portion of the rear member, and wherein the rear member forms at least a portion of a sole of the head.

26. The golf club head of claim 25, wherein the rear member has perimeter weighting portions located at the heel side and the toe side of the head and a thinned portion between the perimeter weighting portions, and wherein the wall follows contours of the rear member to at least partially cover the perimeter weighting portions and the thinned portion.

27. The golf club head of claim 25, wherein the wall covers a front portion of a top surface of the rear member.

28. A golf club head comprising:

a face member including a face having a striking surface configured for striking a ball and a rear side located behind the face, the face member having a first projection extending rearwardly from the rear side of the face member proximate a heel side of the head and a second projection extending rearwardly from the rear side of the face member proximate a toe side of the head;

a rear member connected to the rear side of the face member and having a front surface confronting the rear side of the face member, the rear member having a first receiver in the front surface on the heel side of the head and a second receiver in the front surface on the toe side of the head, wherein the first projection is received in the first receiver and the second projection is received in the second receiver; and a resilient material separating the rear member from the face member, wherein the resilient material engages the rear member and the face member and is configured to transfer momentum between the face member and the rear member, wherein the face member has a recess located on a sole of the head, wherein at least a portion of the rear member is received in the recess, such that the rear member forms at least a portion of the sole.

* * * * *